US007902502B2

(12) United States Patent
David

(10) Patent No.: US 7,902,502 B2
(45) Date of Patent: Mar. 8, 2011

(54) MULTICHANNEL ENERGY ANALYZER FOR CHARGED PARTICLES

(75) Inventor: Donald E. David, Broomfield, CO (US)

(73) Assignee: The Regents of the University of Colorado, a body corporate, Denver, CO (US)

( * ) Notice: Subject to any disclaimer, the term of this patent is extended or adjusted under 35 U.S.C. 154(b) by 278 days.

(21) Appl. No.: 12/092,314

(22) PCT Filed: Oct. 31, 2006

(86) PCT No.: PCT/US2006/060414

§ 371 (c)(1),
(2), (4) Date: Jun. 25, 2008

(87) PCT Pub. No.: WO2007/053843

PCT Pub. Date: May 10, 2007

(65) Prior Publication Data

US 2008/0290287 A1 Nov. 27, 2008

Related U.S. Application Data

(60) Provisional application No. 60/731,993, filed on Nov. 1, 2005.

(51) Int. Cl.
*H01J 49/22* (2006.01)
*H01J 49/48* (2006.01)

(52) U.S. Cl. ..... 250/305; 250/396 R; 250/397

(58) Field of Classification Search ..... 250/305, 250/396 R, 397
See application file for complete search history.

(56) References Cited

U.S. PATENT DOCUMENTS

| | | | | |
|---|---|---|---|---|
| 3,735,128 | A | 5/1973 | Palmberg | |
| 3,739,170 | A * | 6/1973 | Bohn et al. | 250/305 |
| 3,818,228 | A | 6/1974 | Palmberg | |
| 4,584,474 | A | 4/1986 | Franchy et al. | |
| 4,764,673 | A * | 8/1988 | Bryson et al. | 250/305 |
| 4,959,544 | A | 9/1990 | Sukenobu | |
| 5,032,724 | A | 7/1991 | Gerlach et al. | |
| 5,097,126 | A | 3/1992 | Krivanek | |
| 5,357,107 | A | 10/1994 | Ibach | |
| 5,594,244 | A | 1/1997 | Prutton | |
| 6,762,408 | B1 | 7/2004 | Read | |

FOREIGN PATENT DOCUMENTS

| | | |
|---|---|---|
| EP | 06839647.2 | 9/2010 |
| WO | WO87/07762 | 12/1987 |

OTHER PUBLICATIONS

David, D.E. et al., "A multichannel electron energy loss spectrometer for low-temperature condensed films"; *J. of Chem. Phys.* (Dec. 2004), 121(21):10542-10549.

Lorraine, P.W. et al., "A differentially pumped electron-energy-loss spectrometer with multichannel detector for time-resolved studies at intermediate ambient pressures"; *Rev. Sci. Instrum.* (1992) 63(2):1652-1670.

* cited by examiner

*Primary Examiner* — Jack I Berman
(74) *Attorney, Agent, or Firm* — Greenlee Sullivan PC

(57) ABSTRACT

The present invention provides charged particle energy deflectors, analyzers, devices, device components and methods for terminating charged particle systems and electrically isolating device components. One embodiment of the present invention provides a transparent field termination system for a cylindrical charged particle deflector that is capable of providing an electric field that closely approximates the substantially logarithmically varying electric field of the deflector. The present invention also provides multichannel charged particle analyzers and multichannel EEL spectrometers capable of measuring charged particle energy distributions, including electron energy distributions, with enhanced resolution and sensitivity compared to conventional analyzers.

20 Claims, 19 Drawing Sheets

MULTICHANNEL ENERGY ANALYZER FOR CHARGED PARTICLES

CROSS-REFERENCE TO RELATED APPLICATIONS

This application is the U.S. National Stage of International Application No. PCT/US2006/060414, filed Oct. 31, 2006 and published in English on May 10, 2007 as WO 2007/053843 A2, which claims the benefit of U.S. Provisional Application 60/731,993, filed Nov. 1, 2005; all of which are hereby incorporated by reference in their entirety to the extent not inconsistent with the disclosure herein.

STATEMENT REGARDING FEDERALLY SPONSORED RESEARCH OR DEVELOPMENT

This invention was made, at least in part, with United States governmental support awarded by National Science Foundation Grant CHE-0140478. The United States Government has certain rights in this invention.

BACKGROUND OF INVENTION

Charged particle analyzers are useful device components in a number of important analytical tools, including most mass spectrometers and electron spectrometers. These device components provide a means of spatially segregating charged particles on the basis of one or more physical properties, thereby allowing for selective analysis and detection. Dispersive charged particle energy analyzers, for example, are a class of device components wherein a flow of charged particles are exposed to electric and/or magnetic fields that give rise to a spatially varying intensity distribution. Energy dependent deflections caused by the electric and/or magnetic fields segregate the charged particles with respect to position along one or more dispersion axes on the basis of their kinetic energies. Integration of a dispersive energy analyzer with a suitable detector, therefore, allows for measurement of charged particle energy distributions.

In one type of a conventional charged particle analyzer, electrons or other charged particles enter the particle deflector through an entrance aperture and pass between two curved electrodes, for example, see U.S. Pat. Nos. 4,584,474 and 5,357,107. The charged electrodes will cause the charged particles to travel different paths according to the different energies of the particles. The charged particles will exit the deflector through an exit window onto a detector. A field termination system at the exit window is necessary to prevent electric fields generated by the detector and other electronics from distorting the trajectory of the charged particles separated on the basis of their energies.

Electron energy loss spectroscopy (EELS) is an example of such a technique wherein measured electron energy distributions are used to determine physical and chemical properties of bulk solids, interfaces, and gas phase materials. EELS provides a highly sensitive (e.g. <0.1% of a monolayer in some cases), nondestructive and broadly applicable analytical technique, particularly useful for characterizing the composition and physical properties of surface adsorbates. This technique has been successfully applied to the analysis of a range of materials including single crystalline metals, semiconductors and insulators, vapor deposited films, and evaporated materials. Other useful applications of EELS include fundamental studies of molecular surfaces, and catalytic reactions on solid surfaces.

In EELS, a beam of electrons having a selected, essentially monochromatic energy distribution is provided incident to a sample material undergoing analysis. A portion of the incident electrons are inelastically scattered by processes that involve energy transfer to the sample material. The scattered electrons are subsequently collected, and analyzed with respect to energy distribution using a combination of charged particle collection optics, a dispersive charged particle energy analyzer and a detector. Measurements of electron energy distributions of the inelastically scattered electrons provided by this technique can be related to vibrations, surface phonons, and electronic energy transitions of the sample material undergoing analysis with knowledge of the energy distribution of the incident beam of electrons.

Recent advances in EELS instrumentation have resulted in significant enhancements in the resolution and sensitivity accessible using this technique. A new generation of high resolution-electron energy loss spectrometers (HR-EELS) are now capable of accessing an energy resolution less or equal to about a few meV, depending on the scattering properties of the material undergoing analysis. This improvement in resolution makes this technique comparable to complementary IR-spectroscopy techniques, and greatly expands the overall applicability and usefulness of EELS as an analytical tool.

Advances in multichannel instrument designs have also made a significant impact on the performance of EELS instrumentation. In a single channel EELS spectrometer, electrons are passed through a deflector and a portion of the electrons having a relatively narrow distribution of energies are passed through an exit slit and detected. In the single channel configurations, the energy distribution is usually determined by accelerating or decelerating the electrons by a know amount before they enter the analyzer. In a multichannel EELS spectrometer, the exit slit is replaced by an exit window capable of passing spatially separated electrons having a significantly broader distribution of energies. In the multichannel configuration, the energy distribution is determined by simultaneously detecting the spatially separated electrons using a position sensitive detector, such as a multichannel plate detector. Integration of multichannel analysis and detection systems provides a means of measuring broad electron energy distributions at once, thereby resulting in significant improvements in sensitivity and versatility.

Critical to achieving further enhancements in resolution and sensitivity in multichannel EELS instrumentation is the development of dispersive electron energy analyzers having reduced electron optical aberrations. To provide high resolution it is beneficial that a multichannel electron energy analyzer make use of the energy dispersion of the electrons undergoing analysis across the largest extent of the exit plane possible. A field termination system that at least approximately maintains the electric field established in the analyzer is typically necessary to achieve uniform dispersion of charged particles across the dispersion axes of the analyzer. For analyzers employing a conventional cylindrical charged particle deflector comprising two concentrically positioned cylindrical electrodes the electric potential varies as $\ln(r/r_o)$, where r is the radial position of a charged particle undergoing analysis and $r_o$ is the average radius of the two cylinder segments comprising first and second electrodes. Termination of this analyzer configuration via equipotential termination electrodes, such as a partially transparent metallic grid electrode, distorts the logarithmic electrical field distribution and, thus, introduces undesirable aberrations in the positions of energy separated electrons exiting the analyzer. Such aberrations undermine the uniformity of the spatial separation of charged particles achieved in the analyzer, resulting in a significant decrease in resolution.

Several approaches have been pursued to address problems associated with field termination in multichannel electron analyzers. One approach, involves termination using a plurality of electrodes held at systematically varying electric potentials. Ho and co-workers, for example, developed a termination system consisting of an array of 22 individually biased metal ribbons positioned in a vertical orientation perpendicular to the gradient of the electric field (P. W. Lorraine, B. D. Thomas and W. Ho, (1992) Rev. Sci. Instrum. vol. 63, page 1652). Biasing of individual electrodes in the array is reported to generate a selectively varying electric field for termination of a cylindrical charged particle deflector. This termination scheme is susceptible to significant drawbacks, however, including generation of a non-uniform electric field that leads to irregular dispersion of electrons undergoing analysis, thereby decreasing resolution. In addition, this termination scheme requires use of a bias resistor network which adds to the overall cost and complexity of the analyzer.

It is clear from the foregoing that there exists a need for charged particle energy analyzers capable of providing high resolution and good sensitivity. Multichannel energy analyzers are needed having a termination system that provides a continuous and selectively varying electric field at the entrance and/or exit planes of the analyzer. Termination device components and methods providing high charged particle transmission and capable of approximating the logarithmic electric field of a cylindrical deflector are needed to provide high resolution electron spectrometers, including HR-EELS spectrometers.

SUMMARY OF THE INVENTION

The present invention provides charged particle energy deflectors, analyzers, devices, device components and methods for terminating charged particle systems and/or electrically isolating device components. Termination systems of the present invention are transparent and are capable of providing a continuous and selectively varying electric field for termination of charged particle devices or components employing electric fields, including electric fields varying linearly and non-linearly. One embodiment of the present invention provides a transparent field termination system for a cylindrical charged particle deflector that is capable of providing a terminating electric field that closely approximates the substantially logarithmically electric field of a deflector. The present invention also provides multichannel charged particle analyzers and multichannel electron spectrometers capable of measuring charged particle energy distributions, including electron energy distributions, with enhanced resolution compared to previous multichannel charged particle analyzers with cylindrical geometry.

In one aspect, the present invention provides devices, device components and methods for field terminating charged particle systems. A field termination system of this aspect of the present invention comprises a plurality of resistive termination elements. Resistive termination elements are provided in a configuration that is at least partially transparent with respect to the transmission of incident charged particles. In one embodiment of a cylindrical charged particle analyzer, for example, resistive termination elements are positioned in an array where each resistive termination element is in a plane that extends radially from the principal cylinder axis. In this configuration, the resistive elements of the array are parallel to each other and the spacing between adjacent resistive elements is selected to provide efficient transmission (e.g. greater than 99%) of incident charged particles. Application of a potential difference across resistive termination elements of the present invention results in current flow through these elements that generates an electric field that varies in at least one physical dimension. Biasing the first and second ends of the resistive termination elements with appropriately selected electric potentials, therefore, provides a means of generating a terminating electric field having an electric potential as a function of position selected to match (or approximate) the electric fields generated by a given charged particle system or device component, such as a deflector in a charged particle energy analyzer.

In one embodiment of the present invention, a plurality of resistive termination elements is positioned across an exit window of an exit plate in a charged particle system. In a further embodiment, a plurality of resistive termination elements is also positioned across an entrance aperture of an entrance plate in a charged particle system. The resistive elements can be placed on the surface of the plate on either side or both sides of the plate. Additionally, the resistive termination elements can be placed within the plane of the exit window or entrance aperture. The ends of the resistive termination elements can terminate at or near the edge of the exit window or entrance aperture, or can extend toward the edges of the exit plate or entrance plate. The resistive termination elements are electrically connected to an independent power (bias) source or electrodes to provide an electric field across the exit window.

In some embodiments, each resistive termination element is positioned in a plane that is normal to the axis of the electrodes of the deflector and in the path of the charged particles. In this embodiment, the axis of the electrodes is defined as a line that extends from the bottom (or bottom plate) of the deflector to the top (or top plate) of the deflector. This line is generally perpendicular to the line extending from the distal end of the deflector to the proximal end of the deflector. In embodiments where the electrodes are cylindrical, each resistive termination element is positioned in a plane that extends radially from the principal cylinder axis. Where the principal cylindrical axis is vertical, the resistive termination elements are arranged horizontally with each resistive termination element positioned directly above or below the other resistive elements.

In one embodiment of the present invention, use of resistive termination elements having substantially uniform composition, cross sectional physical dimensions (e.g. cross sectional area, width and/or diameter) and/or electrical resistivity provides a means of generating a terminating electric field that varies across the length of the resistive termination elements. In one embodiment, the terminating electric field varies linearly as a function of the length of the resistive termination elements. Preferably, the resistive termination elements are selected to provide an electric field that approximates the electric field in the charged particle deflector. In one embodiment, the electric field in the deflector varies substantially logarithmically and the terminating electrical field varies linearly in a manner that approximates the logarithmic electric potential of the deflector.

The invention also includes configurations wherein the cross sectional physical dimensions and/or compositions of resistive termination elements in the array vary selectively in order to adjust the terminating electric potential across the resistive elements. Selection of the electric potentials applied to the ends of the resistive termination elements, the physical dimensions (e.g. cross sectional dimensions, length, etc.) of the resistive termination elements, the composition and electrical properties of the resistive termination elements or any combination of these parameters provides a means of selecting the functional form of the terminating electric field across the resistive elements. This functionality allows the bias voltages, physical dimensions, composition and/or applied electrical potentials to be selected and/or selectively varied in a manner which tunes the terminating electric field to match or at least approximate the electric field of a given charged particle system or device component. Use of a parallel array of resistive termination elements, where the resistive elements are positioned in a plane normal to the axis of the electrodes, is particularly useful for preventing electric fields from external device components, such as charged particle optics and detectors, from deleteriously affecting (e.g. distorting) the electric fields in the charged particle deflector, while still allowing a sufficient number of charged particles to be detected.

The resistive termination elements can be positioned in any configuration that provides a terminating field useful for a given application and is at least partially transparent. In one embodiment, where the electrodes of the deflector are cylindrical, each resistive termination element is positioned within the plane of the exit window and in a plane that extends radially to the principal cylinder axis so that the resistive termination elements are parallel to one another. Optionally, the resistive termination elements are positioned parallel to each other and equally spaced from one another. Alternatively, the spacing between adjacent parallel resistive termination elements is not uniform throughout the entire window. For example, the resistive termination elements may be spaced closer together near the top and bottom of the window and further apart near the center of the window. In another embodiment, the resistive termination elements are not parallel or do not extend radially from the principal cylinder axis. For example, the resistive termination elements may be provided in a fan shaped configuration where the ends of the resistive termination elements are closer together on one side of the window while the opposite ends are spaced further apart. Additionally, the resistive termination elements may cross each other within the exit window. In one embodiment, a plurality of resistive termination elements intersect each other at or near the center of the exit window, resembling spokes in a wheel. Altering the orientation and spacing of the resistive termination elements allows the terminating field to be selectively adjusted. Similarly, the terminating electric field can be adjusted by selectively altering, e.g. increasing or decreasing, the resistivity across the length of the resistive termination elements. The resistivity can be selectively altered by selectively increasing or decreasing the diameter the resistive termination elements along the length. Alternatively, the resistivity can be altered by selectively coating or doping the resistive termination elements with materials that increase or decrease the resistivity.

One embodiment of the invention provides a charged particle analyzer comprising a charged particle deflector having a proximal end and a distal end, wherein the deflector comprises an inner electrode having a cylindrical shape and an outer electrode having a cylindrical shape. The proximal end of the deflector is defined herein as the end of the deflector closest the source of the charged particles of interest, or where the charged particles enter the deflector. The distal end is defined herein as the end of the deflector closest to a charged particle detector, or where the stream of charged particles exits the deflector before contacting a detector or analyzer. The inner and outer electrodes are positioned in relation to a principal cylinder axis and separated from each other by a selected distance, wherein application of different electric potentials to the inner and outer electrodes establishes an electric field in the deflector, wherein charged particles conducted through the deflector are spatially separated on the basis of their energies. The analyzer further comprises a field termination system comprising a plurality of resistive termination elements positioned across the distal end of the deflector in the path of the charged particles. The resistive termination elements transmit at least a portion of the charged particles. The deflector optionally comprises an entrance plate comprising an entrance aperture, wherein the entrance plate is connected to the proximal end of the inner and outer electrodes, and an exit plate comprising an exit window, wherein the exit plate is connected to the distal end of the inner and outer electrodes. In this further embodiment, the resistive termination elements are positioned across the exit window.

In a further embodiment, the resistive termination elements each have a first end electrically connected with the inner electrode and a second end electrically connected with the outer electrode. The composition and physical dimensions of the resistive termination elements are selected to provide an electric field that approximates the electric field in the charged particle deflector. Alternatively, the resistive termination elements are appropriately biased by external power supplies to provide an electric field that approximates the electric field in the charged particle deflector.

The charged particle deflector may additionally comprise an electrically biased top plate, bottom plate or both. The inner and outer electrodes have top surfaces in physical contact with the top plate and bottom surfaces in contact with the bottom plate. In one embodiment, the deflector further comprises a top plate comprising an insulating material coated with an intermediate conductive layer that covers at least part of the insulating material to form electrical contacts having appropriately shaped boundaries. The top plate also has a surface resistive film coating the conductive layer and the insulating material. In this embodiment, the inner edge of the conductive layer is in electrical contact with the inner electrode, and the outer edge of the conductive layer is in electrical contact with the outer electrode. In one embodiment, the deflector similarly comprises a bottom plate comprising an insulating material coated with an intermediate conductive layer that covers at least part of the insulating material to form electrical contacts having appropriately shaped boundaries. The bottom plate also has a surface resistive film coating the conductive layer and the insulating material. In this embodiment, the inner edge of the conductive layer of the bottom plate is in electrical contact with the inner electrode, and the outer edge of the conductive layer is in electrical contact with the outer electrode.

The charged particle deflector may additionally comprise an electrically biased entrance plate, exit plate or both. In one embodiment, the entrance plate, positioned within an entrance plane of the deflector, comprises an insulating material coated with an intermediate conductive layer that covers at least part of the insulating material, where the conductive layer has a first point of electrical contact with the outer electrode and a second point of electrical contact with the inner electrode. The positions of the first and second points of electrical contact are selected to provide a terminating electric field that approximates the electric field in the charged particle deflector. The entrance plate also has a surface resistive film coating the conductive layer and the insulating material.

In one embodiment, the charged particle deflector further comprises an exit plate, positioned in the exit plane of the deflector, comprising an insulating material coated with an intermediate conductive layer that covers at least part of the insulating material, where the conductive layer has a first point of electrical contact with the outer electrode and a second point of electrical contact with the inner electrode. The positions of the first and second points of electrical contact are selected to provide a terminating electric field that approximates the electric field in the charged particle deflector. The exit plate also has a surface resistive film coating the conductive layer and the insulating material. Useful exit plates of the present invention have a window for transmitting charged particles separated on the basis of energy and are integrated with the plurality of resistive termination elements.

In cylindrical charged particle deflectors of the present invention, application of different electric potentials to the inner and outer electrodes establishes an electric field in the deflector that varies systematically along the portion of the radii of the outer cylindrical electrode positioned between the inner and outer electrodes. Charged particles pass through an entrance slit or aperture and are conducted through the deflector. The electric field in the deflector causes energy dependent deflection of charged particles passing through the deflector. These deflection processes selectively disperse the charged particles and result in spatial separation on the basis of particle energy. Charged particles spatially separated on the basis of their energies are received and at least partially transmitted by the plurality of resistive termination elements. A potential difference is applied across the resistive termination elements in a manner generating an electric field that matches (or approximates) the electric field in the deflector. Matching the intensity distribution of fields generated in the deflector and in the termination system is beneficial because it minimizes degradation or disruption of the spatial separation of particles achieved in the deflector and also provides an effective means of electrically isolating the deflector with respect to external electric fields, such as those generated by external device components, such as charged particle optics (e.g. lenses) and/or detectors.

In one embodiment, the inner and outer electrodes are concentrically positioned about the primary cylinder axis, thereby generating an electric field that varies substantially logarithmically. In one embodiment the plurality of resistive termination elements have biasing voltages, compositions, electrical resistivities and physical dimensions that are selected to provide a linear, or close to linear, terminating electric field that approximates the substantially logarithmically varying field in the deflector. Biasing in this embodiment may be provided by establishing electrical contact between the ends of the resistive termination elements with the outer and inner electrodes or with a conductive layer in electrical contact with the outer and inner electrodes, or alternatively may be provided by applying an independent power (bias) source to the ends of the resistive termination elements.

In another aspect, the present invention provides a field terminated, multi-channel charged particle analyzer having an entrance plane for receiving charged particles and an exit plane for transmitting charged particles that are spatially separated on the basis of their energies. In an embodiment providing high resolution and sensitivity, a charged particle analyzer of the present invention comprises a charged particle deflector having a novel field termination system comprising a plurality of resistive termination elements positioned across the exit window and in the path of the charged particles spatially separated on the basis of their energies. The charged particle deflector comprises an inner electrode and an outer electrode separated from each other by a selected distance, wherein application of different electric potentials to the inner and outer electrodes establishes an electric field in the deflector, and wherein charged particles conducted through the deflector are spatially separated on the basis of their energies. The deflector further comprises an entrance plate connected to the inner and outer electrodes having an entrance aperture, and an exit plate connected to the inner and outer electrodes having exit window. The charged particle analyzer also comprises a multichannel detector in fluid communication with the deflector. The detector is positioned to receive and detect the charged particles passing through the resistive termination elements across the exit window. In a further embodiment, the resistive termination elements are positioned in a plane that is normal to the axis of the electrodes.

In a further embodiment, the charged particle analyzer comprises a cylindrical charged particle deflector wherein the inner and outer electrodes have a cylindrical shape and are positioned about a principal cylinder axis. In one embodiment, each resistive termination element is positioned in a plane that extends radially with respect to the principal cylinder axis. Optionally, a frame, holder or other alignment device may be incorporated into the analyzer to hold the resistive termination elements in this desired orientation. Optionally, the analyzer further comprises a plurality of additional resistive termination elements positioned across the entrance aperture and in the path of the charged particles received by the analyzer, wherein the additional resistive elements also are positioned in a plane that extends radially with respect to the principal cylinder axis. The charged particle analyzer optionally comprises a source for the charged particles and the necessary optics (e.g., a series of lenses) for focusing the charged particles into the deflector.

In this embodiment, each end of the resistive termination elements is electrically connected to the inner or outer electrode or to a separate power source to allow an electric potential to be applied across the resistive termination elements. In one embodiment, the composition and physical dimensions of the resistive termination elements are selected to provide an electric field that approximates the electric potential in the deflector. Specifically, in an analyzer having a cylindrical deflector the resistive termination elements provide an electric field that varies linearly in a manner that approximates the logarithmic electric field in the deflector.

It is important to note that resistive termination elements of analyzers and field termination systems of the present invention may be electrically biased in a variety of ways. In some embodiments, electrical biasing is achieved by establishing electrical contact between the resistive termination elements and the inner and outer electrodes of the deflector. On the other hand, in other embodiments, biasing is achieved by establishing electrical contact between the resistive termination elements and external power supply device components. For example, first ends of the termination elements may be electrically contacted with a first power supply having a first electric potential and second ends of the termination elements may be contacted with a second power supply having a second electric potential. Individual field termination elements in the array may be individually addressed to separate power supplies held at selected electric potentials. Biasing of resistive termination elements provided by incorporation of one or more external power supply is beneficial for certain applications as it provides an additional degree of freedom useful for establishing a spatially varying electric potential having a selected functional form. For example, biasing first and second ends of resistive termination elements using first and second external power supplies is useful for establishing a spatially varying electric potential that varies linearly having a selected slope and intercept.

Resistive termination elements useful in this aspect of the invention have well defined, and optionally uniform, physical and electrical properties, and are mechanically strong. The resistive termination elements at least must be mechanically strong enough to allow them to be placed across the exit window without breaking. In addition, the resistive termination elements have high electrical resistivity (e.g. equal to or greater than about 10 Ω-m; more preferably equal to or greater than about 50 Ω-m; more preferably equal to or greater than about 80 Ω-m; more preferably equal to or greater than about 100 Ω-m) which minimizes the spatial extent and intensities of unwanted magnetic fields cause by current flow through individual termination elements. Magnetic fields are undesirable because they can cause unwanted deflection of charged particles that disrupts the extent and uniformity of spatial separation achieved. In one embodiment, the radial alignment of resistive termination elements in relation to the primary cylinder axis only gives rise to deflection, if any at all, of charged particles in the plane perpendicular to the dispersion plane. Radial alignment of resistive termination elements is beneficial, therefore, because deflection in this direction is not expected to significantly affect the energy separation identified by the detector. Use of resistive termination elements having small cross section dimensions (e.g. less than about 10 microns) is useful for providing highly transparent field termination systems. Use of symmetrical or asymmetrical parallel arrays of resistive termination elements is useful for providing termination over large areas, for example over the entire area of an entrance aperture, slit or exit window of a charged particle device. Any number of resistive termination elements may be used in the present methods and devices, as long as the resulting configuration is at least partially transparent, or, in some applications, highly transparent. Selection of the number of resistive termination elements is typical made on the basis of the area over which electric fields are to be terminated.

Graphite fibers are useful resistive termination elements due to their high resistivity (10 s of Ω-m), very small diameter (approximately 10 microns) and excellent mechanical strength. Graphite fibers termination elements are also inexpensive and readily manipulated to achieve effective integration in a charged particle analyzer. Other materials useful for resistive termination elements include, but are not limited to, semiconducting polymer based fibers and other semiconducting polymer materials, carbon fibers, carbon nanotubes, ceramic materials and hybrid materials. The resistive termination elements include, but are not limited to, fibers, threads, tubes, strips and ribbons.

A field termination system of the present invention is partially transparent, meaning that it transmits at least a portion of the charged particles. Preferably, a field termination system transmits at least 70% of incident charged particles; more preferably at least 90% of incident charged particles; more preferably at least 99% of incident charged particles.

Termination systems of charge particle analyzers of the present invention may have one or more additional device components that enhance overall performance (e.g. resolution, throughput and sensitivity).

Charged particle deflectors, analyzers, device components and methods of the present invention may be used with dispersive elements having other geometries, including, but not limited to, dispersive elements having a hemispherical geometry. Charged particle deflectors, analyzers, or device components of the present invention may be constructed from any suitable materials as known in the art. For example, materials useful for the construction of the outer and inner electrodes and other device components include, but are not limited to, copper, molybdenum, and titanium.

Charged particle analyzers of the present invention may further comprise one or more position sensitive detectors, as are known in the art, positioned to received and detect charged particles spatially separated on the basis of their energies that are transmitted by the plurality of resistive termination elements. Exemplary position sensitive sensors include, but are not limited to, a multichannel detector, a microchannel plate or device capable of generating electromagnetic radiation upon impact with a charged particle, such as a phosphorus screen. In one embodiment, the detector generates an electronic signal, such as with an electron multiplier, in response to impact with a charged particle. In another embodiment, the detector generates photons and utilizes subsequent light detection via photomultiplier tubes or a diode array. Embodiments of this aspect of the present invention may include a charged particle lens positioned between the plurality of resistive termination elements and the multichannel detector to increase detection sensitivity and collection efficiency. Use of a parallel array of resistive field termination elements of the present invention is useful for minimizing or eliminating disturbances and/or distortions of the electric field in the defector caused by penetration of external electric fields.

Also provided by the present invention is a method of field terminating a charged particle analyzer by providing a plurality of resistive termination elements in fluid communication with a component of the analyzer. An electric field is applied across the resistive termination elements, which approximates the electric field that is applied to the component.

Another embodiment of the present invention is a transparent field termination system comprising a plurality of resistive termination elements, wherein each of the resistive termination elements has a first and second end; and an electric potential applied to the first and second ends of each resistive termination element, wherein application of the electric potential generates an electric field across the plurality of resistive termination elements. In one embodiment, the electric field varies linearly as a function of length of the resistive termination elements. Preferably, the resistive termination elements are in fluid communication with an additional device or component and provide an electric field that matches or approximates the electric field in the device or component. Optionally, the resistive termination elements are provided in a parallel array.

Termination systems and charged particle analyzers of the present invention provide useful device components in a wide range of analytical instrumentation, including but not limited to electron spectroscopy and mass spectroscopy. For example, methods and devices of the present invention provide multichannel electron spectrometers having enhanced sensitivity and resolution, particularly for EEL spectroscopy applications. Methods and devices of the present invention are applicable to charged particles other than electrons, such as ions and aggregates thereof. Applications of the present invention include charged particle analysis in mass spectrometry.

BRIEF DESCRIPTION OF THE DRAWINGS

FIG. 8 shows different configurations of the resistive termination elements.

DETAILED DESCRIPTION OF THE INVENTION

Figure 1:
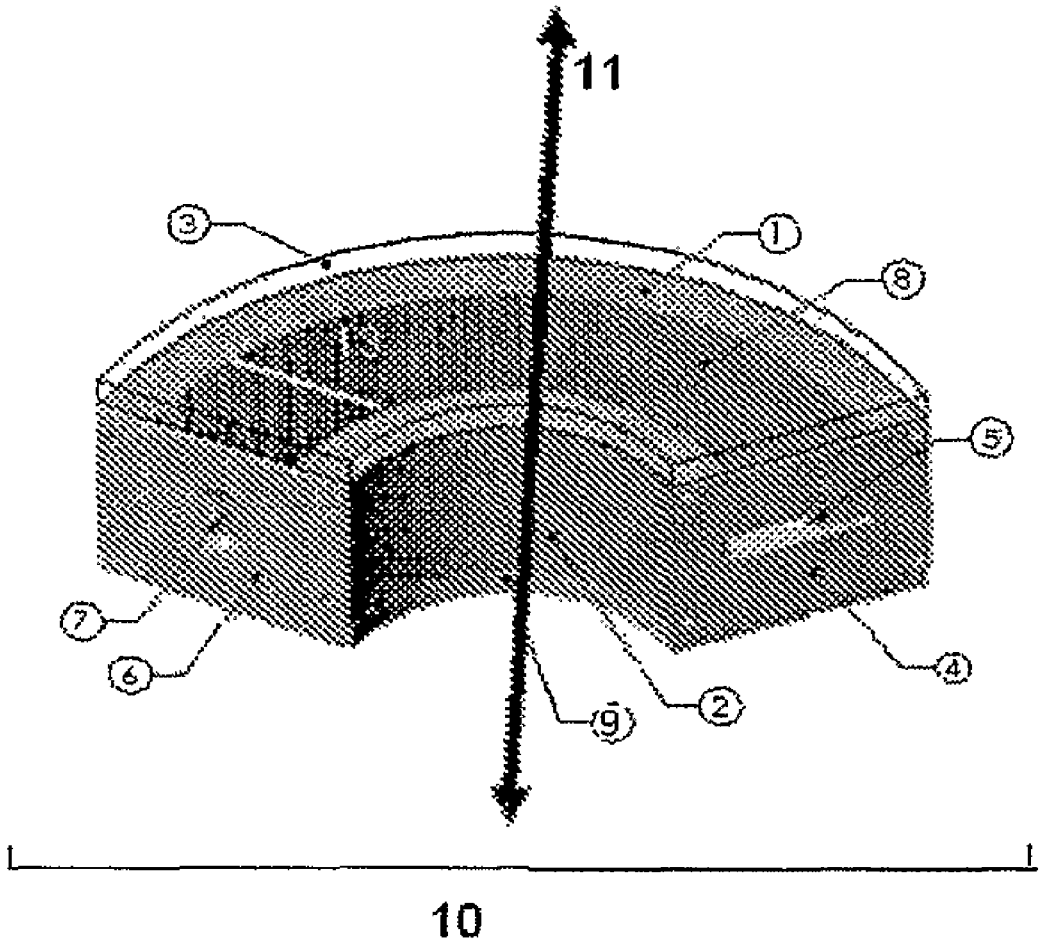
FIG. 1 shows a charged particle deflector of the present invention for spatially separating charged particles on the basis of their energies.

Referring to the drawings, like numerals indicate like elements and the same number appearing in more than one drawing refers to the same element. In addition, hereinafter, the following definitions apply:

A "charged particle analyzer" refers to a device that is used to spatially separate charged particles passing through the device based on the energies of the particles, often through the application of an electric field. Charged particle analyzers of the present invention comprise an inner and outer electrode separated by a selected distance. "Electrode" in this context refers to an electric conductor or emitter which applies an electric field across the space between the inner and outer electrode.

"Electric field" is used to describe an electric field that may be constant or can change over distance. In the present invention, different voltages are applied to the inner electrode and outer electrode resulting in an electric field between the two electrodes. The electric field will vary according to the position in relation to the two electrodes. In an ideal cylindrical analyzer, the electric potential at any given point between the electrodes varies logarithmically as $\ln(r/r_0)$, where $r_0$ is the average radius of the analyzer and r is the radial position. As used herein, "an electric potential that varies linearly" or "electric field that varies linearly" refers to an electric potential or field that changes primarily in proportion to distance.

"Electrically charged particles" and "charged particle" are used synonymously in the present description and refer to any material having an electric charge of either positive or negative polarity. For example, electrically charged particles may include, but are not limited to, electrons, ions, aggregates of ions, ion complexes, electrically charged clusters, electrically charged particulate matter, electrically charged droplets and electrically charged crystals. "Ion" refers generally to multiply or singly charged atoms, molecules, or macromolecules, of either positive or negative polarity and may include charged aggregates of one or more molecules or macromolecules.

As used herein, "transparent" refers to the capability of a device or device component to at least partially transmit incident charged particles. "Highly transparent" refers to the capability of a device or device component to transmit at least 70% of incident charged particles. For example, a transparent field termination system for a charged particle deflector of the present invention at least partially transmits the incident charged particles, such as ions or electrons, from the deflector to a detector or other subsequent component. Preferably, the resistive termination elements and field terminations systems of the present invention transmit 70% or more of the incident charged particles.

"Cylindrical" refers to a shape of an element or device component having the form of at least a segment of a cylinder. Cylindrical elements or device components of the present invention may have an arcuate shape.

"Parallel" refers to a geometry in which two surfaces or device components are equidistant from each other at all points and have the same direction or curvature. As used herein, the term parallel is intended to encompass some deviation from absolute parallelism. In some embodiments of the present invention, parallel resistive termination elements of a field termination system may exhibit deviations from an absolutely parallel configuration that do not significantly impact a given field termination device application. In a field termination system for a charged particle analyzer, for example, parallel resistive termination elements of a field termination system may exhibit deviations from absolute parallelism that do not give rise to disruptions in the trajectories of charged particles exiting the analyzer that would significantly impact the charge particle analysis, such as analysis of the energies of electrons exiting the charged particle analyzer.

"In fluid communication" refers to materials, devices and device components that are in contact with a fluid such as a flow of bath gas, charged particles or both. Materials devices and device components in fluid communication may be characterized as upstream or downstream of each other.

"Approximates the electric field in the charged particle deflector" and similar language means that the terminating electric field produced at the resistive termination elements or other device components matches the electric filed produced in the deflector or differs from the electric field produced in the deflector by no more than 10%, preferably by no more than 5%, more preferably by no more than 2%, more preferably by no more than 1%.

"In electrical contact" means that one component of a device is in contact with another component such that electrons are freely conducted from one component to the other. "In electrical connection" refers to one device component that is connected to another device component, either directly or through a conductive material that is in direct contact with both components, such that electrons and are freely conducted from one component to the other.

"Position sensitive detectors" refer to any detector or sensor used to provide positional data for an object. Typically, this is achieved by determining where on the detector the object, such as an electron or a photon, makes contact. A position sensitive detector can be one dimensional (providing positional data along a single axis), two dimensional (providing continuous positional data along the X and Y axis), or even three dimensional (for example, PET-CT scans).

As used herein, "electrical resistivity" or "resistivity" (also known as specific electrical resistance) is a measure of how strongly a material opposes the flow of electric current. Resistivity is measured in ohm meters (Ω-m). A low resistivity indicates a material readily allows the movement of electrical charge.

As used herein, "resistive termination elements" are small structures having high electrical resistivity (e.g. equal to or greater than about 10 Ω-m; more preferably equal to or greater than about 50 Ω-m; more preferably equal to or greater than about 80 Ω-m; more preferably equal to or greater than about 100 Ω-m). Resistive termination elements of the present invention have a diameter equal to or less than approximately 100 microns; preferably equal to or less than approximately 50 microns; more preferably equal to or less than approximately 10 microns; more preferably equal to or less than approximately 5 microns, but have sufficient mechanical strength to allow the resistive termination elements to be placed across the exit window of a charged particle deflector or analyzer without breaking. The resistive termination elements can be any material or combination of materials having the requisite resistivity, size and mechanical strength. Resistive termination elements include, but are not limited to, semiconducting polymer based fibers and other semiconducting polymer materials, carbon fibers, carbon nanotubes, ceramic materials, and hybrid materials. Optionally, resistive termination elements can comprise coatings over part or the entire element to selectively control the resistivity.

In the present invention, the resistive termination elements at the exit window of a charged particle deflector or analyzer should be at least partially transparent, preferably highly transparent, to the incident charged particles. Increasing the number or size of the resistive termination elements can result in a stronger terminating field but would reduce the transmission of the incident charged particles. For example, a solid film across the exit window would allow little or no charged particles to pass to the detector. However, there should be at least enough resistive termination elements so that the electromagnetic fields from the detector and other electronics do not perturb the charged particles before they pass through the exit plate.

In the following description, numerous specific details of the devices, device components and methods of the present invention are set forth in order to provide a thorough explanation of the precise nature of the invention. It will be apparent, however, to those of skill in the art that the invention can be practiced without these specific details.

This invention provides device and methods for terminating charged particle systems, including charged particle analyzers, ion/electron lens systems and electrostatic deflectors. The present invention provides transparent field termination system capable of providing a continuous, spatially varying electric field that matches (or approximates) the electric field in a given charged particle deflector.

FIG. 1 shows a charged particle deflector 10 of the present invention for spatially separating charged particles on the basis of their energies. The cylindrical charged particle deflector 10 comprises outer electrode 1 having a cylindrical shape and inner electrode 2 also having a cylindrical shape. Inner electrode 2 and outer electrode 1 and are concentrically positioned about a primary cylinder axis 11 and are separated by a selected distance 13.

A charged particle deflector 10 of one embodiment of the present comprises a top plate 3 and bottom plate 9 (note: top plate is shown as transparent to allow perspective view), entrance plate 6, exit plate 4 and array of resistive termination elements (not shown in FIG. 1 to allow perspective view). As shown in FIG. 1, entrance plate 6 has an aperture 7 for transmitting electrically charged particles, and exit plate 4 has an exit window 5 where the array of resistive termination elements are positioned for transmitting electrical charged particles having undergone separation on the basis of their energies. Also shown in FIG. 1 is saw tooth blazing 8 on the inner surfaces of inner electrode 2 and outer electrode 1 to minimize detection of reflected charged particles. Application of different electric potentials to the inner electrode 2 and outer electrode 1 establishes an electric field in the deflector 10 having an electric potential that varies logarithmically along the portion of the radii of the deflector 10 positioned between inner electrode 2 and outer electrode 1.

Figure 2:
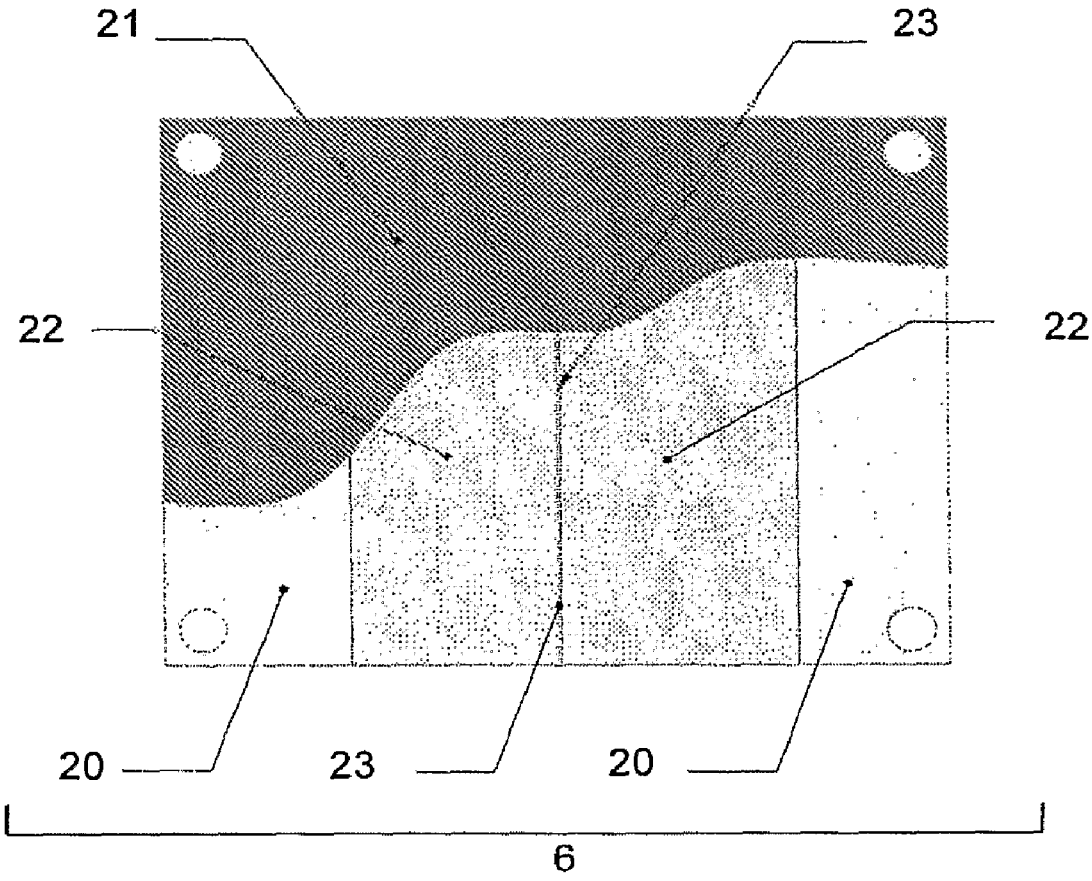
FIG. 2 illustrates an entrance plate of a charged particle deflector of the present invention.

FIG. 2 illustrates an entrance plate 6 of a charged particle deflector of the present invention. In one embodiment, entrance plate 6 is a resistive film electrode comprising a ceramic insulating material 22 (e.g. machinable glass) having an overlapping conductive layer 20 and resistive film 21 on its surface. As shown in FIG. 2, entrance plate 6 is coated with an intermediate conducting layer 20, such as a metal layer, which provides electrical contacts for biasing entrance plate 6. Entrance plate 6 is also coated with one or more resistive films 21 (e.g. a graphite film) that covers the entire face of the plate (note: only a portion of resistive film 21 is shown in FIG. 2 to allow visualization of intermediate conducting layer 20 and the underlying insulating material 22). The conducting layer 20 on the ceramic insulating material 22 sets the potential boundary of the resistive film, and biasing of entrance plate 6 is provided by electrical contact between conductive layer 20 and the inner electrode 2 and outer electrode 1. This configuration eliminates the need for additional external voltage sources and provides a terminating electric field which approximates the logarithmic electric fields in the deflector. In a useful embodiment, the thickness of the resistive film 21 is sufficiently controlled such that the total current through the films is small enough such that any magnetic fields generated do not appreciably affect the trajectory of charged particles passing through entrance plate 6. Also shown in FIG. 2 is entrance slit 23 for transmission of charged particles into the deflector.

Figure 3:
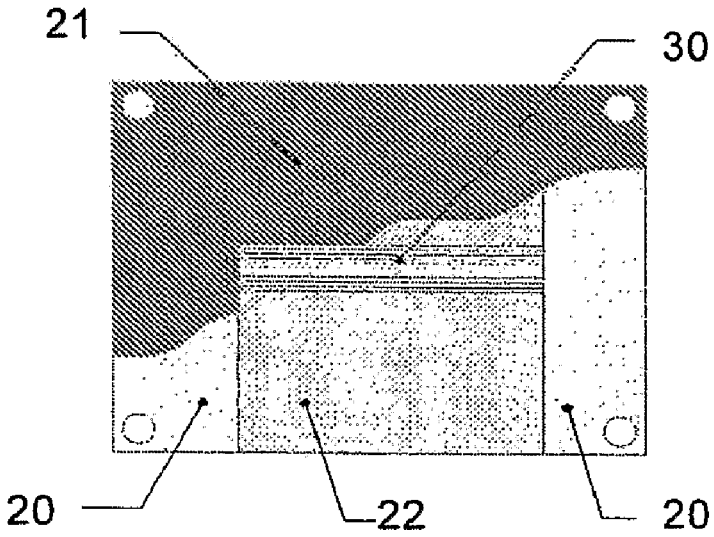
FIG. 3 illustrates an exit plate of a charged particle deflector of the present invention.

FIG. 3 provides an expanded front view of exit plate 4 of a charged particle deflector of the present invention. In one embodiment, exit plate 4 is a resistive film electrode comprising a ceramic insulating material 22 (e.g. machinable glass) having an overlapping conductive layer 20 and resistive film 21 on its surface (note: only a portion of resistive film 21 is shown in FIG. 3 to allow visualization of insulating material 22 and conducting film 20 beneath the resistive film 21). Similar to the entrance plate 6 configuration shown in FIG. 2, the conducting layer 20 on the ceramic substrate sets the potential boundary of the resistive film, and biasing is provided by electrical contact between conductive layer 20 and the inner electrode 2 and outer electrode 1.

Also shown in FIG. 3, is an array of resistive termination elements 30, such as an array of graphite fibers. Resistive termination elements 30 are positioned within the exit window 5 and are provided in the path of charged particles spatially separated by the deflector on the basis of their energies. Each of the resistive termination elements 30 in the array is positioned in a plane that extends radially with respect to the principal cylinder axis 11 (not shown). In the embodiment shown in FIG. 3, resistive termination elements 30 are arranged in a symmetrical parallel array of nine resistive termination elements 30 that extend across the entire area of exit window 5. First and second ends of each resistive termination element are in electrical contact with conductive layers 20 on exit plate 4, thereby generating a linear electric field that approximates the logarithmic electric field in the deflector. Resistive termination elements 30 are particularly useful for preventing electric fields from external device components, such as electron optics or a detector, from deleteriously affecting (e.g. distorting) the electric fields in the deflector.

Figure 4:
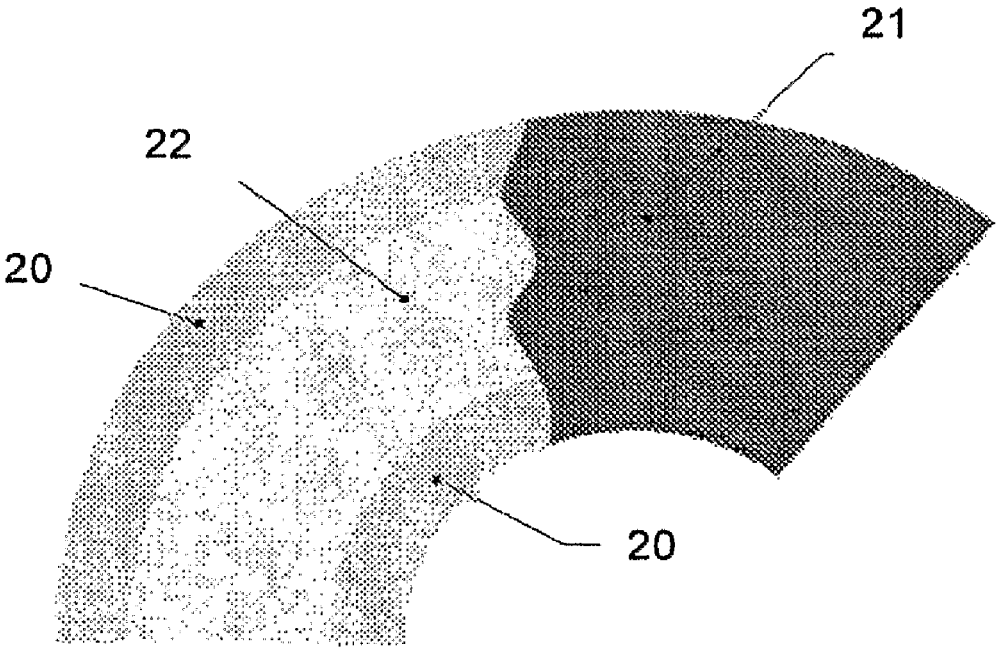
FIG. 4 shows a top plate of a deflector of the present invention.

FIG. 4 is an expanded top view of top plate 3 of a deflector of the present invention. Top plate 3 is a resistive film electrode comprising a ceramic insulating material 22 (e.g. machinable glass) having an overlapping conductive layer 20 and resistive film 21 on its surface (note: only a portion of resistive film 21 is shown in FIG. 4 to allow visualization of insulating material 22 and conductive layer 20 beneath the resistive film 21). The conductive layers 20 of the top plate 3 have the shape of two concentric sections of annular discs with an intervening gap that is equal to the distance 13 separating inner electrode 2 outer electrode 1. Bottom plate 9 has an equivalent configuration. This configuration provides a logarithmic electric field that matches the electric field in the deflector.

Figure 5:
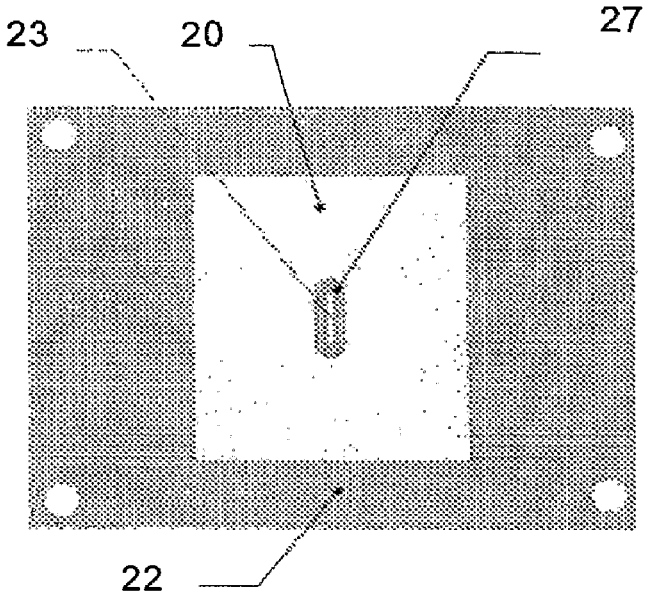
FIG. 5 shows a front face of an entrance insert assembly.

FIG. 5 shows a front face of an entrance insert assembly. FIG. 5 illustrates entrance slit 23, conductive layer 20 and ceramic insulating material 22. Also shown in FIG. 5, is metal slit insert 27. Use of a metal slit insert 27 provides a significant benefit for entrance plate components of the present invention made of machinable ceramic, rather than conventional metal entrance plates. It is very difficult to machine directly into a ceramic material a slit that is narrow enough with sharp, well defined edges to provide good transmission properties. Therefore, use of metal slit insert 27 is beneficial because it allows the slit itself to comprise a metal material (e.g. 0.005" thick foil), but still retain the insulating properties of the ceramic for the rest of the part. The inner edges of entrance slit 23 are coated with conductive layer 20, so the metal slit insert 27 is attached to entrance slit 23 with electrically conductive, high-temperature epoxy.

Figure 6:
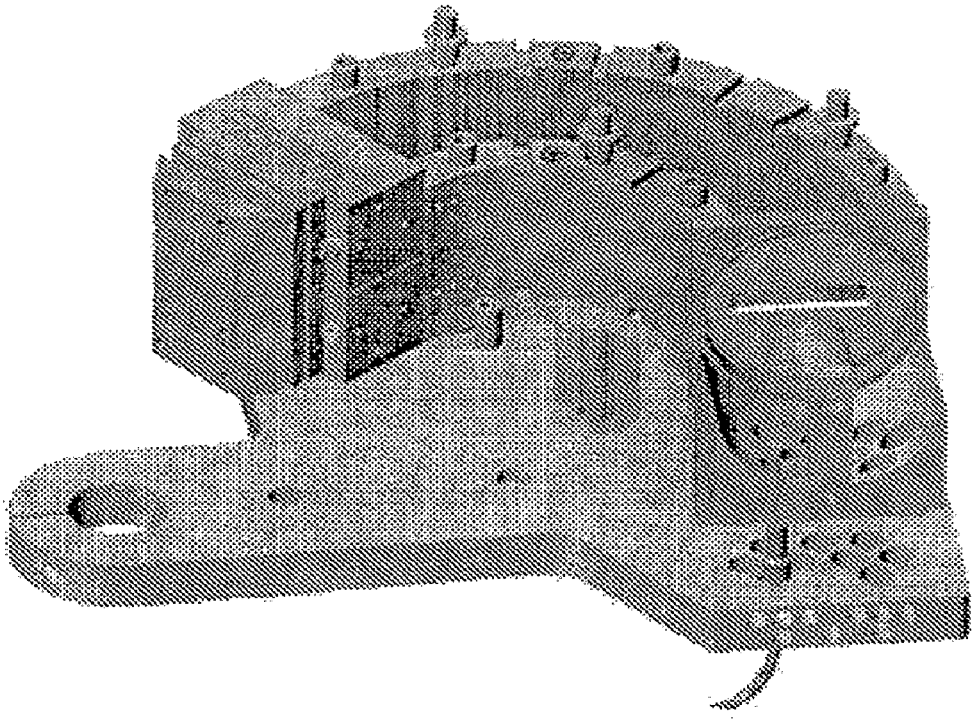
FIG. 6 provides a perspective view of a charged particle deflector of the present invention having a field termination system comprising an array of resistive termination elements.
Figure 7:
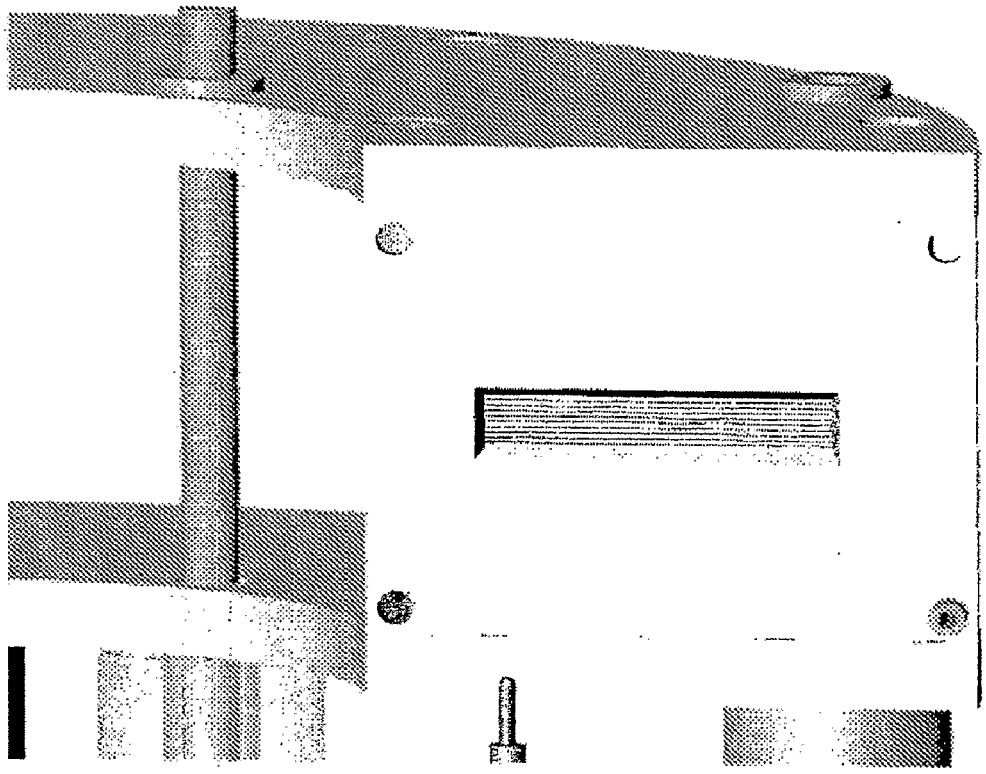
FIG. 7 illustrates an array of resistive termination elements provided in a manner at least partially covering the exit window of a deflector of the present invention.

FIG. 6 provides a schematic drawing showing a perspective view of a charged particle analyzer of the present invention having a charged particle deflector 10 and a field termination system comprising an array of resistive termination elements 30. FIG. 7 provides an expanded view of an exit plate 4 having an array of resistive termination elements 30 provided in a manner at least partially covering the exit window 5 of a deflector 10 of the present invention.

Figure 8A:
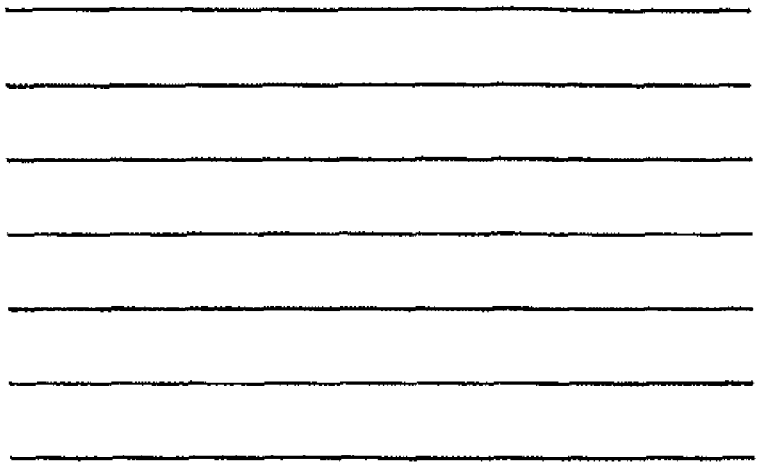
FIG. 8A shows a configuration of the resistive termination elements where the resistive termination elements are parallel and equally spaced to each other.
Figure 8B:
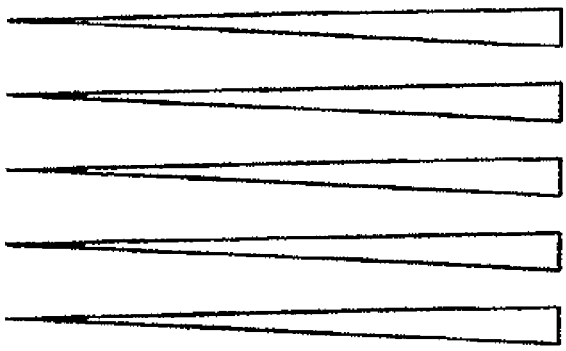
FIG. 8B shows a configuration where the diameter of the resistive termination elements increases from one end to the other.

The resistive termination elements 30 can be positioned in any configuration that provides a terminating field and is at least partially transparent. FIG. 8A shows a configuration of the resistive termination elements where the resistive termination elements are positioned parallel to each other and equally spaced to each other. FIG. 8B shows an additional configuration where the diameter of the resistive termination elements increases from one end to the other.

EXAMPLES

The examples set forth below illustrate, but do not limit, the invention.

Example 1

A Multichannel Electron Energy Loss Spectrometer for Analysis of Low-Temperature Condensed Films A wide-gap multichannel cylindrical deflection electron energy analyzer suitable for measuring the weak signals characteristic of electronically inelastic electron energy loss spectra is described herein. In general, see David et al. (2004) "A Multichannel Electron Energy Loss Spectrometer for Low-Temperature Condensed Films", Journal of Chemical Physics, Vol. 121, Number 21, pages 10542-10550; and David et al. (2004) "Joint experimental and theoretical study of vibrationally inelastic electron scattering on propane," Journal of Chemical Physics, Vol. 121, Number 21, pages 10551-10555. The analyzer utilizes a plurality of resistive termination elements and has nearly ideal fringing field termination. Its resolution and energy dispersion were characterized as a function of energy by solving numerically the equation of motion of electrons in an ideal cylindrical electric field. The numerical results for the radial location of the electrons at the detector as function of the entrance location, angle, and energy are closely approximated by a second order polynomial, and match closely those observed. The detection efficiency of the analyzer is 100-150 times better than that of an equivalent single-channel instrument, but limited energy transmission of the zoom lens system used in this embodiment reduces the efficiency by a factor of about two. The performance of the new instrument was demonstrated by measuring the $^3E_{1u}$ electronic spectrum of benzene in only 2 min and the spectrum of endo-benzotricyclo[4.2.1.0$^{2,5}$] nonane.

Electron Energy Loss Spectroscopy (EELS) is commonly used to investigate the vibrations of molecules, particularly those adsorbed on metal surfaces. EELS also has been used to study vibrational and electronic excitation of small molecules in the gas phase. These measurements are mostly limited to specific incident energies that excite negative ion resonances, at which molecules have greatly enhanced inelastic scattering cross sections. Because of its different selection rules, EELS offers access to otherwise unobservable spin-forbidden and symmetry-forbidden transitions.

Despite the potential benefits, relatively little vibrational and electronic EELS has been done on condensed films and virtually none on reactive intermediates isolated in inert gas matrices, where EELS offers the possibility of initiating photochemical reactions by spin-forbidden electronic excitation. This may be significant in organic photochemistry, where it is often important to avoid the manifold of singlet excited states and to effect triplet excitation directly. The ordinarily used photosensitization technique works well in solution but is difficult to apply to species contained in dilute solids.

The reason little electronic EELS on condensed films has been published is clear—the experiments are quite difficult. To keep the cold sample clean long enough to make a measurement, the entire instrument, including a cryostat to condense the sample, has to be housed in a vacuum system operating below $10^{-10}$ torr. Outside negative ion resonance regions, electronic excitation cross sections are low (typically $<10^{-17}$ cm$^2$). This means low count rates (usually <10 counts/s) and long integration times (sometimes days) when measurements are done on single-detection-channel instruments of the type normally used for vibrational EELS. Consequently, in order to facilitate the application of EELS to the electronic structure of reactive intermediates, an EEL spectrometer with a multichannel detector was designed, constructed, and characterized. This new spectrometer improves counting efficiency by a factor of at least 50 relative to a single-channel instrument and makes electronic EELS on dilute low-temperature condensed films practical. It offers improved resolution and uniformity of energy dispersion over a previously reported design.

Description of the Multichannel EEL Spectrometer

The spectrometer is housed in a standard ultrahigh vacuum system ($<10^{-10}$ torr), with a manipulator for accurately positioning an electrically conductive and reflective substrate for sample deposition, and a sample inlet system. Several additions and modifications have been made to accommodate matrix isolation and to extend the spectral range. A continuous-flow liquid helium cryostat was added for cooling the substrate below 4 K, the zoom lenses in the electron optics were modified to permit a larger range of incident beam and loss energies, and the single-detection-channel electron energy analyzer was replaced with a position sensitive multichannel analyzer to increase sensitivity. Also added was the ability to make limited gas-phase measurements by constructing an alternate sample inlet and tip for the cryostat. Each part of the spectrometer is discussed below.

UHV System

Figure 9:
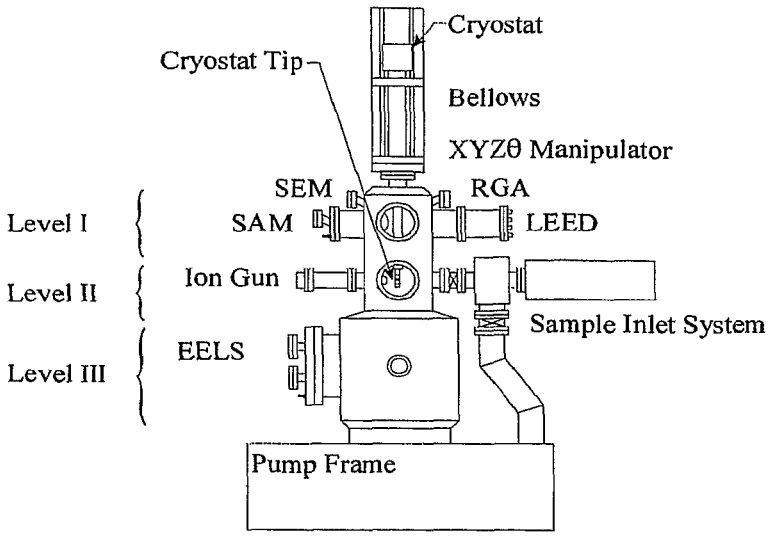
FIG. 9 provides an overall view of the EELS vacuum system showing the liquid helium cryostat, level I for sample characterization, level II for sample preparations, lever III for EELS measurements, and the pumping system.

The EEL spectrometer is housed in a bakeable (200° C.) UHV chamber with a base pressure of approximately $2\times10^{-11}$ torr when the cryostat is warm or approximately $8\times10^{-12}$ torr when the cryostat is operating with liquid helium. Pressure is measured with an ionization gauge controller (Perkin-Elmer Digi-gauge III) connected to a nude-type gauge protruding directly into the main part of the chamber. The system is divided into three levels (FIG. 9). The upper Level I is used for determining the condition of the metal substrate and vacuum. Level II is used for cleaning the metal substrate and for sample preparation. The bottom Level III houses the EEL spectrometer. FIG. 9 provides an overall view of the EELS vacuum system showing the liquid helium cryostat, level I for sample characterization, level II for sample preparations, level III for EELS measurements, and the pumping system.

Capping the vacuum system is a continuous-flow liquid He (or liquid $N_2$) cryostat (Cryo Industries of America, Model RC-110) mated to the chamber with an XYZθ manipulator (Thermionics Model FB102.5-1-1-20 manipulator and Model RNN-150 differentially pumped rotary platform). An atomically flat Ag(111) single crystal held in a carrier and a quartz crystal microbalance are mounted on the lower end of the cryostat. The Ag crystal is the normal substrate on which samples are deposited for measurement, and the microbalance is used to calibrate the sample deposition system. The XYZθ manipulator permits the substrate and microbalance to be positioned at any of the three levels of the vacuum chamber and also to be rotated 360° around the vertical axis of the cryostat. The vacuum chamber sits atop an ion pumping system (Perkin-Elmer, TNB-X Series 1000) augmented with a turbomolecular pump (Balzers, TPU330) to handle inert gases. A small separately pumped vacuum chamber is connected to the side of the main chamber through a gate valve and is used for substrate and sample preparation. More detailed descriptions of the cryostat tip and components in each chamber level are provided below.

Cryostat and Sample Carrier

A polished and gold-plated oxygen-free high-conductivity copper (OFHC) tip is attached to the cold lower end of the cryostat with six machine screws and an indium gasket to insure excellent thermal contact. The tip and lower end of the cryostat shaft are electrically insulated from the upper part of the cryostat (at ground potential) by an electrical isolator. This allows the tip to be connected to an electrometer for monitoring the electron current to the sample.

Machined into the cryostat tip is a recessed pad designed to receive the sample carrier. The carrier is locked onto this pad by engaging three pins, spaced radially at 120° increments and loaded by an adjustable leaf spring which pulls the pins and carrier against the pad. With the aid of a coating of colloidal graphite (Aerodag G, Acheson Colloids) on the back of the carrier, this system ensures that there is good thermal and electrical contact to the cryostat tip.

The sample carrier is a 1 mm thick molybdenum disk with six tapered slots around its edge and a cover ring that clamps the sample substrate to the front face. Three slots mate with the pins on the cryostat tip while the other three slots can be engaged by three similar pins mounted on the end of a Zθ sample manipulator (see FIG. 9) that moves at right angles to the cryostat. The slots and pins are designed in a way that permits a clockwise rotation of the sample manipulator to lock the carrier to the cryostat tip and to unlock it from the manipulator. A counterclockwise rotation does the opposite. This arrangement allows the sample manipulator to move the carrier between the cryostat and the small side vacuum chamber, described below.

The cryostat tip also holds a quartz crystal microbalance (thin-film monitor), a silicon diode temperature sensor, and a cartridge heater. The microbalance is able to measure as little as 0.1% of a monolayer of condensed Ar and allows an accurate calibration of the sample deposition system. When used in conjunction with a helium flow meter and needle valve flow regulator on the cryostat transfer line, the temperature sensor and heater allow the temperature of the cryostat tip to be adjusted to any temperature between ~4 and ~400 K. As much of the cryostat tip as possible and a part of the cryostat shaft are enclosed by a radiation shield that minimizes the radiative heat load to the tip.

Level I. Substrate Characterization

Level I contains a Varian Scanning Auger Microprobe (SAM, Model 918-2707/2601) and Secondary Electron Microscope (SEM, Model 981-2601), a Low Energy Electron Diffractometer (LEED), and a Residual Gas Analyzer (RGA, Vacuum Generators Micromass). The cleanliness of the crystal is monitored with the SAM, which readily detects the common contaminants (C, S, O) at levels necessary to insure that no spurious signals are measured by EELS.

The LEED was designed and built locally. An axial electron gun operates at less than 10 pA beam current, the diffraction pattern is amplified with a stack of five 40 mm diameter micro-channel plates, and then individual electrons are counted with a resistive-anode type position-sensitive detector (Quantar Technologies, Inc.). It permits the determination of the periodicity, and thus expected reflectivity, of the Ag crystal substrate.

Level II. Sample Preparation

Level II contains an Ar source (Leybold-Heraeus Model 867-916), the gas and solid sample inlet systems, and a Zθ-motion manipulator which travels into the main vacuum chamber through a gate valve from a small side chamber. The side chamber is equipped with a separate turbomolecular pump (Balzers, TPU 170), an optical pyrometer (Raytek, Thermalert) for measuring the temperature of the substrate carrier, and a load lock and magnetically-coupled linear manipulator that allows the substrate, along with its carrier, to be removed from vacuum for polishing or replacement. As described above, the Zθ-motion manipulator is designed to move the substrate carrier to and from the cryostat tip and side chamber. On the end of the manipulator that holds the substrate carrier is located an electron-beam heater (Thermionics Model 10-0300) that is used in conjunction with the optical pyrometer to anneal the Ag crystal. Regular maintenance of the silver (111) crystal is needed to keep it clean and reflective. This is done by sputtering the crystal with 1 keV $Ar^+$ ions for 10-15 min and then annealing with the electron-beam heater at 450° C. for 30 min. Between experiments, usually only one cycle is needed, but if the crystal has been removed from vacuum, three or more sputter-and-anneal cycles are required.

Level II also houses a volatile sample inlet system consisting of a high-speed pulsed valve (General Valve Corp. Series 9 valve with a 0.002" diameter orifice and an Iota One, Series 9000, controller) connected to a heated gas-handling manifold. The valve is attached to the main vacuum chamber through a small linear manipulator. Gas exiting the valve travels down a 6" long gold-coated tube and passes through a micro-channel diffuser before it is deposited evenly on the substrate. Samples are prepared in the gas-handling manifold where they can be mixed and adjusted to the appropriate backing pressure for the pulsed valve. Pressures in the manifold are measured with two capacitance manometers (MKS Barocel®, type 221A) which together permit a measurement range of $10^{-3}$-$10^{3}$ torr. Alternatively, low vapor pressure solid samples may be deposited by installing a heated sample probe in place of the substrate carrier on the side chamber manipulator and then positioning the manipulator directly in front of the microbalance or substrate crystal, already attached to the cryostat tip, for calibration or deposition.

The substrate is an Ag(111) single crystal 10 mm in diameter and 2 mm thick (MonoCrystals, Inc.) with a stated crystal surface orientation within 1° of the (111) plane. It was polished mechanically and then etched by hand prior to sputtering and annealing.

Gas-phase spectra can be measured by installing an alternate tip for the cryostat and sample inlet. In place of the microbalance and sample carrier, the alternate tip has a cup, cooled by the cryostat, that cryopumps the gas-phase sample that effuses from the end of a stainless steel capillary tube. Electron scattering from the gas stream occurs about 2 mm below the capillary. The sample is fed into the capillary from the same gas-handling manifold that is used for depositing volatile samples on the crystal substrate.

Level III. Electron Spectrometer

Figure 10:
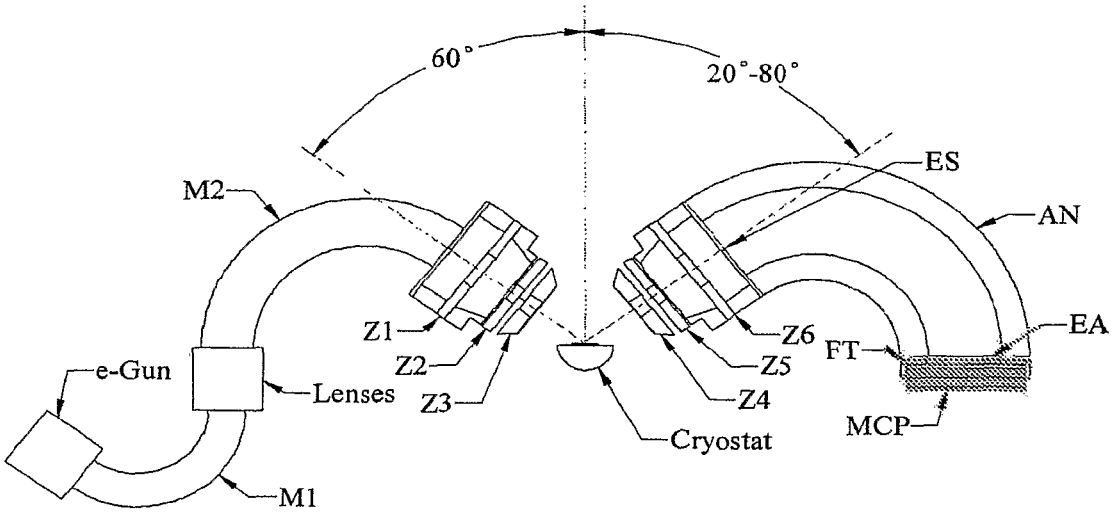
FIG. 10 provides a schematic drawing of the electron optics in the multichannel EEL spectrometer. M1, first monochromator; IL, intermediate lenses; M2, second monochromator; Z1-Z3 and Z4-Z6, zoom lenses for the monochromator and analyzer; ES, entrance slit; AN, analyzer; EA, exit aperture; FT, field terminator; and MCP, microchannel plate detector.

Vibrational and electronic energy loss spectra were measured using two versions of the EEL spectrometer that were enclosed in a double μ-metal magnetic shield that attenuates the earth's magnetic field to approximately 0.1 mG as measured with a magnetometer (HP, model 428BR). The original spectrometer (LK2000-14-R) used a commercial single-channel detector with a double-pass monochromator, a symmetric pair of three-element zoom lenses for focusing the incident and scattered electron beams, and a dispersive 127° cylindrical deflection analyzer. FIG. 10 provides a schematic drawing of the electron optics in the multichannel EEL spectrometer. M1, first monochromator; IL, intermediate lenses; M2, second monochromator; Z1-Z3 and Z4-Z6, zoom lenses for the monochromator and analyzer; ES, entrance slit; AN, analyzer; EA, exit window; FT, field terminator; and MCP, microchannel plate detector. In the modified spectrometer (FIG. 10) the single-channel detector is replaced by a multichannel detector (MCD), and the zoom lens stacks are replaced by new three-element lens systems ($Z_1$-$Z_3$ and $Z_4$-$Z_6$). The energy selective analyzer of the former spectrometer, its entrance slit, and double exit slit are replaced by a wide-gap analyzer (AN), a new entrance slit (ES), and an exit aperture (EA) and detector field-termination plate (FT). The components and operation of each spectrometer are the same up through the second monochromator ($M_2$). However, because of the new components the overall operation and performance of the spectrometers differ substantially. A detailed description of the multichannel spectrometer follows.

Zoom Lenses

The three-element zoom lens stack is a slightly modified version of the one described by Ibach (*Electron Energy Loss Spectrometers: The Technology of High Performance*, edited by P. W. Hawkes (Springer, New York, 1991), vol. 63). The first lens element, $Z_1$ ($Z_6$), has a cylindrical aperture and controls both in-plane (i.e., in the plane of energy dispersion of the monochromator or analyzer) and out-of-plane focusing of the electron beam nearly equally. The second lens element, $Z_2$ ($Z_5$), has a rectangular aperture and provides additional in-plane focusing. The third lens element, $Z_3$ ($Z_4$), is held at the same potential as the target to provide a field-free region around the sample and contains a pupil to limit the in-plane acceptance angle of the analyzer. The potential of the exit (entrance) slit of the monochromator (analyzer) relative to the third lens provides acceleration (deceleration) to control the beam energy at the sample (analyzer).

Each lens element was machined from CP grade titanium and was electropolished and coated with colloidal graphite (Aerodag G, Acheson Colloids) prior to assembly. Element-to-element spacing, alignment, and electrical isolation are provided by accurately cut and electrically shielded alumina tubing, and the assembly is held together by phosphorus-bronze screws running through the tubing. The differences between this lens and that described by Ibach are a reduction in the thickness (6 mm vs. 8 mm) of $Z_3$ ($Z_4$), addition of a pupil (0.6 mm wide) to the sample side of $Z_3$ ($Z_4$), and an increase in the exit slit to target distance (63 mm vs. 60 mm). These changes increase the distance (18 mm vs. 13 mm) between $Z_3$ ($Z_4$) and the sample, providing clearance for the cryostat without appreciably affecting other characteristics of the lenses.

Energy Analyzer

In order for the new multi-channel analyzer to conveniently replace the original single-channel analyzer, the overall dimensions needed to be retained. Thus the height and average radius, $r_0$, of the new cylindrical plates were set at 40.0 mm and 60.0 mm, respectively, the same as in the original instrument. The only other critical dimension dictated by external requirements was that the distance between the plates be large enough to accommodate a standard 25 mm diameter position-sensitive detector. Consequently, the radii of the inner and outer cylinders were chosen to be 45.3 mm and 74.7 mm, for a spacing of 29.4 mm. These dimensions offer the additional convenience that the analyzer constant for the instrument is very nearly one. This means that an electron with an arbitrary energy of 1.000 eV (defined as the pass energy, $E_0$) will follow a trajectory through the analyzer along $r_0$ when a difference of 1.000 V is applied between the cylindrical plates.

The cylindrical deflection plates were wire electro-discharge-machined (wire EDM) from a solid block of CP grade titanium and, like the zoom lenses, were electropolished and coated with colloidal graphite prior to assembly. A fine saw-tooth shaped surface (0.5 mm pitch) was machined into the inner faces of the cylinders to reduce the number of reflected electrons.

In an ideal cylindrical analyzer the electric potential varies as $\ln(r/r_0)$, where r is the radial position, and first order focusing of the electrons with respect to their entrance angle occurs when the entrance and exit slits are separated by 127.28°. In real analyzers it is convenient to terminate the boundaries of the cylindrical plates with equipotential electrodes (i.e., metal plates), but this distorts the ideal field and affects focusing. Several methods have been devised to compensate for these distortions without losing the convenience of equipotential electrodes, but they are valid only for trajectories that begin and end at a particular value of r near $r_0$. For single-channel analyzers this restriction is acceptable since the widths of the entrance and exit slits are very small. However, a practical multichannel analyzer should make use of the energy dispersion of the electrons across as much of the exit plane as possible. This requires a more complicated field termination mechanism, at least one that approximates the ideal logarithmic field in a way that is spatially uniform at the detector on the scale of the desired channel size. This need for uniform field termination is apparent from the results of Ho and collaborators (P. W. Lorraine, B. D. Thomas, and W. Ho, (1992) Rev. Sci. Instrum. vol. 63, page 1652), who saw irregular dispersion in an analyzer that was terminated with 22 biased vertical wires. The analyzer described here uses biased resistive films instead of equipotential metal electrodes or a few biased vertical wires.

As described above, four resistive film electrodes are used to completely terminate the cylindrical plates—top, bottom, entrance plane (with entrance slit), and exit plane (with exit window). Each of these electrodes was machined from flat machinable glass ceramic (Macor, Corning Glass), vapor coated with a chromium adhesion layer and then with gold to form reliable electrical contacts with appropriately shaped boundaries, and then spray coated with colloidal graphite to form resistive films between the contacts. Bias potentials for these metallized areas are provided solely by electrical contact with either the inner or outer cylindrical plate, as appropriate. Thus no external voltage sources are required for field termination other than those already needed for the cylindrical plates. The thickness of the graphite films was controlled to insure that the total current through all films is only a few mA and forms magnetic fields that are too small to appreciably affect electron trajectories.

The top and bottom electrodes are machined from 0.25" thick Macor ceramic and are mirror images of each other. The electrical contacts for the resistive films are deposited in the shape of two concentric sections of annular disks with an intervening gap that has inner and outer radii that match the radii of the cylindrical analyzer plates. Because the potential in a resistive film with this shape also varies as $\ln(r/r_0)$, these films provide perfect field termination except near the film ends. Near these un-metallized edges of the Macor substrate, the potentials vary more nearly linearly with r but are still close approximations to the ideal potentials as described in detail below.

Figure 11:
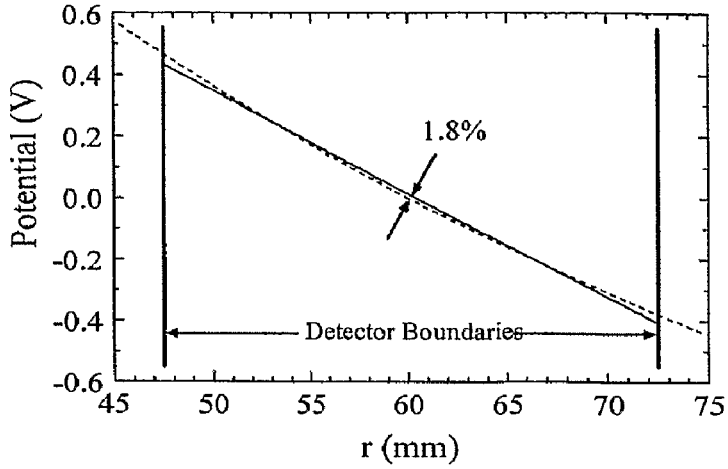
FIG. 11 shows the electric field profiles for an ideal cylindrical deflector (----) and the linear approximation (-) provided by the resistive field terminators. The maximum deviation is 1.8%.

The entrance and exit electrodes are machined from 0.062" thick Macor and incorporate the entrance slit and exit window, respectively. As done for the top and bottom electrodes, metallized areas were deposited along the inner and outer edges of the Macor such that they make electrical contact with the inner and outer analyzer plates. But here the metallized areas define resistive films with parallel boundaries; thus the potentials in these films vary linearly with r, and the field termination is only approximately correct. This error was minimized by adjusting the radial positions of the boundaries of the linear termination field such that there is a least squares fit to the logarithmic field in the analyzer. FIG. 11 shows the electric field profiles for an ideal cylindrical deflector (----) and the linear approximation (-) provided by the resistive field terminators. The maximum deviation is 1.8%. The best fit occurs when the boundaries of the film do not match the radii of the analyzer plates but are shifted inward by about 1.3 mm as shown in FIG. 11. In this case, the linear terminating field deviates from the ideal field by no more than 1.8%.

The entrance slit, centered at $r_0$, is a 0.13×4.0 mm slot cut into a recess in the inlet side of the entrance electrode, i.e., outside the analyzer. Because the inner edges of the slit penetrating the Macor is also metallized, the conducting inlet side of the Macor is in electrical contact with a 0.25 mm wide metal stripe that runs vertically down the center of the analyzer side of the Macor. Since this stripe is itself in electrical contact with the resistive film, bias potential for the whole slit assembly is automatically set at the same value as the potential between the cylindrical plates at $r_0$.

A 29.6 mm wide×4.0 mm high window is machined into the exit electrode to allow electrons to reach the multi-channel detector. If left unaddressed, such a large aperture would create additional field termination problems since it would easily permit any potential associated with the detector to penetrate into the analyzer. Traditionally, field penetration through such apertures is prevented by installing a transparent metal mesh, but this is unproductive in the present application since the uniform potential on the mesh would distort the logarithmic field. The unique solution used here was to string highly resistive fibers horizontally across the window. The high electrical resistivity of the fibers is critically important since it allows the ends of the fibers to be electrically connected like the resistive film to the metallized areas of the Macor without causing currents and magnetic fields that would deflect the electrons. Furthermore, the small magnetic fields that are associated with the fibers only deflect the electrons in the vertical plane and have no effect on the resolution. Effectively, the fibers form a highly transparent continuation of the film, and the linear field approximation is maintained.

Electron Detector

After passing through the exit window of the analyzer, electrons are slightly accelerated (typically by 1-2 eV) through a 60% transparent gold mesh placed 2.0 mm behind the window before they travel another 2.0 mm to the detector. This mesh isolates the analyzer field termination from the +50-200 V bias that is applied to the front face of the detector to accelerate the electrons to an energy that can efficiently trigger an electron cascade in the first micro-channel plate (MCP).

The multi-channel detector (Quantar Technology Inc. Model 3391A) consists of a stack of five circular MCPs, each with and active diameter of 25 mm. The typical gain for the 5-plate stack is $5\times10^7$ with a dark-count rate of 2-3 c/s. The charge packets exiting the rear of the MCPs are collected on a resistive anode, further amplified electronically, and then processed by an analog position analyzer (Quantar Technology Inc. Model 2401B) which computes the spatial positions of the packets. The FWHM spatial resolution for the detector is 400×400 channels or 63.5×63.5 μm, and the maximum count rate over the face of the detector is about 40,000/s. Rates higher than this result in decreasing counting efficiency due to the finite processing speed of the position computer.

Data Acquisition System

The analog signals from the position analyzer are digitized with a 10 MHz, 12-bit analog-to-digital converter (ADC) (National Instruments EISA A2000 DAC) installed in a 486 DX2 microcomputer. Only the ten high-order bits of the ADC are used since this is enough resolution to oversample the spatial resolution of the detector by at least a factor of two. The actual correspondence between detector position and ADC channel depends on the gain of the electronics and was determined experimentally, as described below. A 1024 channel 1-d histogram (X-position, corresponding to energy) or 1024×1024 channel 2-d histogram (X,Y-position) of the signal is then stored in a computer based array according to channel location. The acquired data are processed with a program written in the LabVIEW graphical programming language (Version 3.1, National Instruments Corp.), displayed on a computer monitor in pseudo-real time, and subsequently stored on the computer hard drive.

Numerical Solution of the Equation of Motion

For a cylindrical deflection analyzer (CDA), the trajectory of an electron in the plane normal to the axis of the cylinders is given by the solution to the differential equation $$\frac{d^2u}{d\theta^2} + u = \frac{c^2}{u}, \tag{1}$$

where θ is the angular position coordinate of the electron, $u=r_0/r$, $c^2=1/E\cos^2\phi$, $E=E_n/E_0$, $r_0$ is average radius of the analyzer, r is the radial coordinate of the electron, $E_n$ is the kinetic energy of the electron at the entrance slit, $E_0$ is the pass energy, and φ, is the entrance angle of the electron trajectory relative to $r_0$. Several approximate solutions to the equation have been published that are valid only for $E\cos^2\phi\approx1$. These solutions all lead to the same equation generally quoted for CDAs, $$\delta r_2 = -\delta r_1 + r_0\left(\frac{\delta E}{E_0}\right) - \frac{4}{3}r_0\varphi^2, \tag{2}$$

which gives $\delta r_2$, the deviation of the radial position of the electron from $r_0$ at the exit plane ($\theta=\pi/\sqrt{2}$), in terms of $\delta r_1$, the deviation of the radial position of the electron from $r_0$ at the entrance plane ($\theta=0$), and $r_0$, φ, and $\delta E=E-E_0$, the deviation of the electron energy from $E_0$. The approximate solutions also predict that the radial dispersion is linear in energy according to $$E_0\frac{dy}{dE} = r_0. \tag{3}$$

Equations (2) and (3) are quite adequate for single channel detectors since, for good resolution, φ is kept small and the widths of the entrance and exit slits are limited to only a small fraction of $r_0$. However, for the multichannel detector described here, $E\cos^2\phi$ is permitted to be in the range of 1.0±0.2, and the approximate solutions are inaccurate. Numerical calculations of the electron trajectories in a CDA with Herzog-corrected fringing fields have been carried out where $E\cos^2\phi$ was permitted to be as large as 1.0±0.1. Even for this limited energy range, the trajectories near the edges of the detector were found to be distorted, reducing resolution. Consequently, an ideal $\ln(r/r_0)$ electric field in the present analyzer was approximated as described above. To better characterize the properties of such an analyzer, Equation (1), which has no known analytical solution, was solved numerically.

Figure 12:
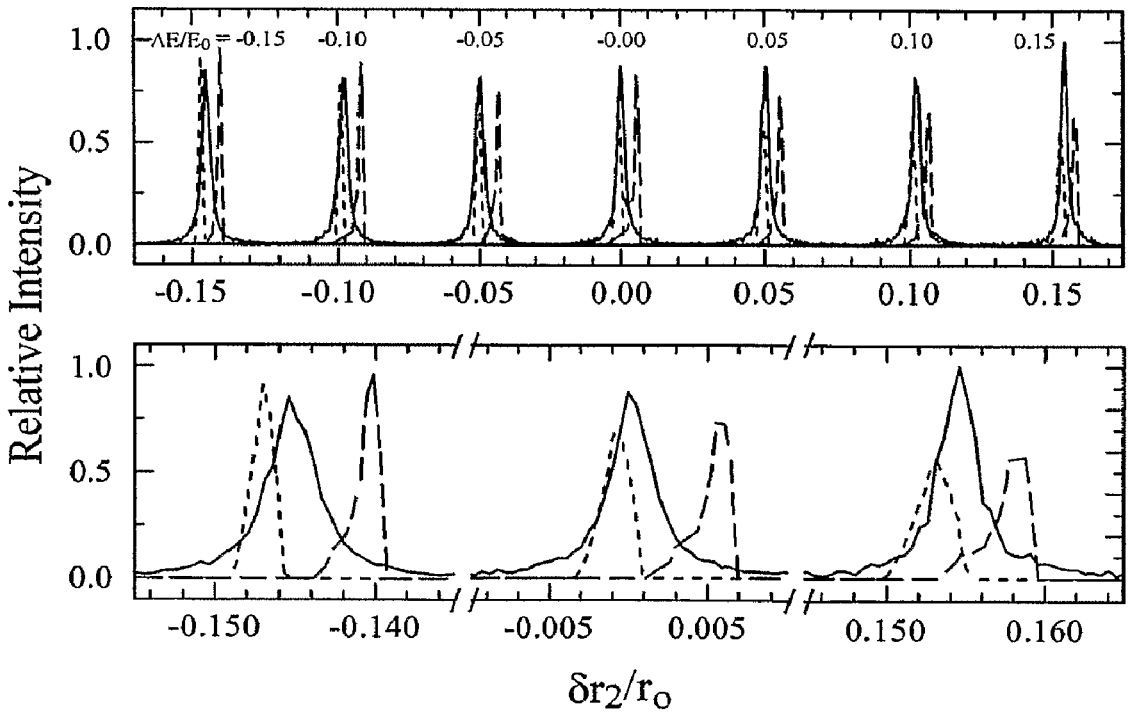
FIG. 12 provides Numerical (••••), Simion (----), and experimental (-) beam profiles that are projected onto the multichannel detector for electrons with seven different energies.

FIG. 12 provides Numerical (••••), Simion (----), and experimental (-) beam profiles that are projected onto the multichannel detector for electrons with seven different energies. The upper plot shows the position and shape of the beams as a function of energy. The lower plot expands the left-hand, center, and right-hand profiles to show details. The results are presented in FIG. 12, which shows a histogram of the $\delta r_2/r_0$ values calculated for over 8,000 initial trajectories (7 values of δE×47 values of δE×25 values of $\delta r_1$) compared to the equivalent Simion and experimental values. The Simion and experimental results are discussed below. Even by eye it is possible to see that the dispersion is nonlinear.

Figure 13:
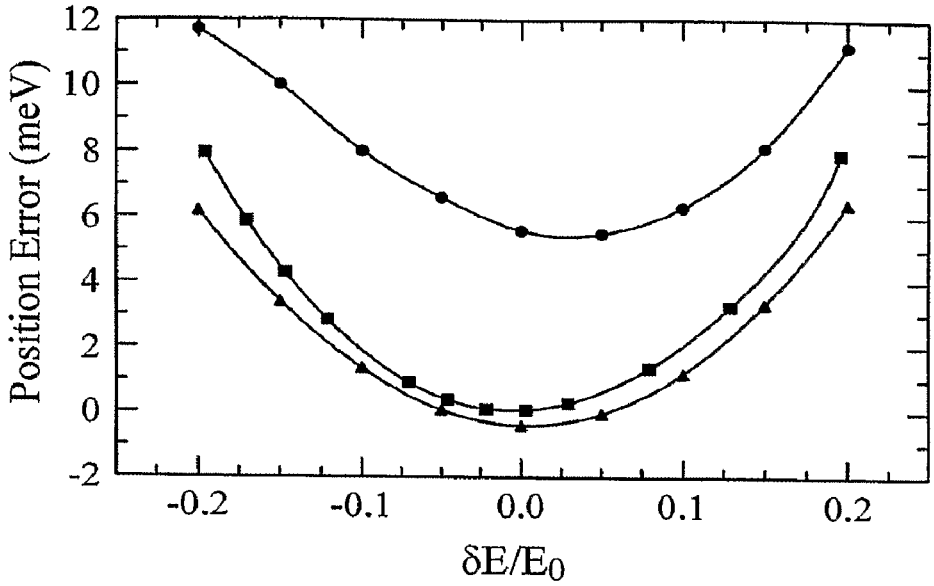
FIG. 13 provides numerical (▲), Simion (●), and experimental (■) curves that show the difference between the positions of the peak maxima shown in FIG. 12.

FIG. 13 provides numerical (▲), Simion (●), and experimental (■) curves that show the difference between the positions of the peak maxima shown in FIG. 12 and the detector positions predicted if energy dispersion were linear with energy (i.e., Eq. 3). In FIG. 13, this nonlinearity is emphasized by plotting the differences between the positions of the maxima of the seven peaks shown in FIG. 12 and the positions expected for a linear dispersion (Eq. 3) vs. $\delta E/E_o$, along with the Simion and experimental results. The data from the numerical solutions of Eq. 1 are fitted well by a second order polynomial that may be used as a calibration equation for the CDA described here (applicable for maximum $\phi=\pm 2.3°$), $$\frac{\delta r_2}{r_0} = 0.16701\left(\frac{\delta E}{E_0}\right)^2 + 1.00033\frac{\delta E}{E_0} - 0.00072 \tag{4}$$

Eq. 4 may be rewritten in a more useful inverse form $$\frac{\delta E}{E_0} = 0.16671\left(\frac{\delta r_2}{r_0}\right)^2 + 1.00107\frac{\delta r_2}{r_0} + 0.00071 \tag{5}$$

giving the relative energy of an electron that strikes the detector at relative position $r_2/r_0$. The experimental results (see below), also plotted in FIG. 13, give $$\frac{\delta E}{E_0} = 0.21101\left(\frac{\delta r_2}{r_0}\right)^2 + 1.00136\frac{\delta r_2}{r_0} + 0.00006 \tag{6}$$

which differs from the numerical results by less than 2 meV.

The numerical solution may also be used to determine a more general version of Eq. 2 by examining how $\delta r_2$ depends upon $\delta r_1$, $\delta E/E_0$, and $\phi$ independently. To a close approximation we find $$\delta r_2 = -\left(\frac{5}{6}\left(\frac{\delta E}{E_0}\right)^2 + \frac{5}{3}\frac{\delta E}{E_0} + 1\right)\delta r_1 + r_0\left(\frac{1}{6}\left(\frac{\delta E}{E_0}\right)^2 + \frac{\delta E}{E_0}\right) - \frac{4}{3}r_0\left(\left(\frac{\delta E}{E_0}\right)^2 + \frac{5}{3}\frac{\delta E}{E_0} + 1\right)\varphi^2 \tag{7}$$

which approaches the linear solution as $\delta E \rightarrow 0$. It is interesting to note that in addition to predicting a nonlinear dispersion, Eq. (7) predicts that the best resolution for a CDA is not located at the center but at the edge of the detector closest to the inner cylinder (also shown in FIG. 12). According to Eq. (7) or Eq. (2), for an accepted angle of 2.3° and entrance slit width of 0.13 mm, the analyzer is expected to blur the image of the entrance slit that is projected onto the center of the exit window by 0.26 mm for an estimated nominal resolution for the analyzer of 5.2 meV ($\Delta E/E_0=2.6\times10^{-3}$). For electrons arriving at the inner edge of the detector, the resolution is expected to improve to ~4.0 meV (−23%), and for those that arrive at the outer edge, it should deteriorate to about 6.6 meV (+27%).

Electron Trajectory Calculations

The charged particle optics simulation program Simion was used to design and estimate the performance of the zoom lenses, cylindrical analyzer, and detector field termination. The program models the geometry of a set of electrodes with a three-dimensional grid. The potential on each electrode is adjusted independently, and the resulting potentials of the grid points between the electrodes are determined by solving the Laplace equation. Charged particles with predefined initial trajectories then may be injected into the grid and the path of the particles estimated according to the forces that act on the particles at each point.

The grid spacing used for simulating the analyzer and detector components was 0.125 mm, sufficient to accurately represent even the electric field around the small fibers strung across the exit window of the analyzer. A grid spacing of only 0.5 mm was sufficient to represent the zoom lens system, which has larger dimensions.

Zoom Lenses

While providing acceleration or deceleration, the zoom lens system for cylindrical analyzers must provide focusing with different strengths for the in-plane and out-of-plane components of motion of the electrons. For multi-channel analyzers there is the additional requirement that the lens be achromatic over the range of energies detected simultaneously by the analyzer. This is a very difficult requirement to satisfy since in charged-particle energies frequently range by orders of magnitude (compared to only a factor of two for optical systems operating at visible wavelengths). Consequently, considerable effort was put into trying to design an achromatic lens, and a number of designs were simulated.

Figure 14:
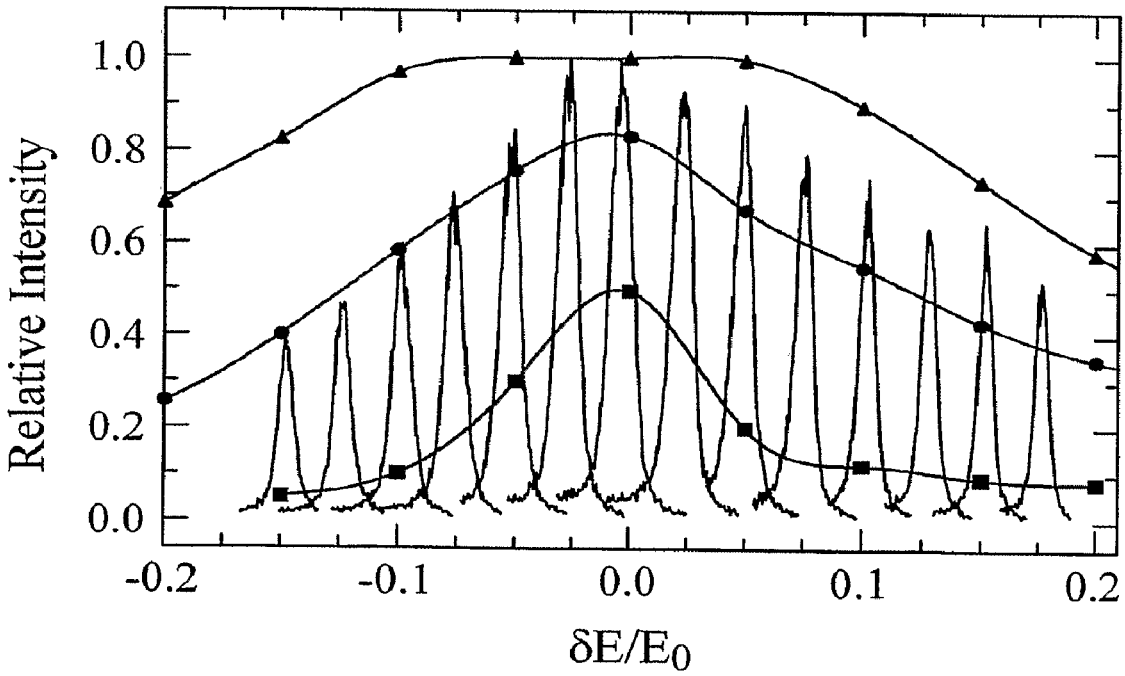
FIG. 14 illustrates simulated zoom lens transmission as a function of energy at nominal incident energies of 20 eV (▲), 10 eV (●), and 1 eV (■) compared to the experimental results at a nominal incident energy of 10 eV.

The simulated voltage acceleration/deceleration curves for the lens in the present embodiment were found to be almost identical to those reported by Ibach. Simulations also show that the pupils added to $Z_3$ and $Z_4$ limit $\phi$ to ±2.3°, and the height of the exit slit limits the out-of-plane acceptance angle to ±1.5°. FIG. 14 provides simulated zoom lens transmission as a function of energy at nominal incident energies of 20 eV (▲), 10 eV (●), and 1 eV (■) compared to the experimental results at a nominal incident energy of 10 eV. The simulated transmission functions, a measure of the cumulative properties of the lens, including magnification, brightness, and chromatic aberrations, are shown in FIG. 14 for $E_0$=2 eV and an incident energy of 10 eV. The measured performance of the real lenses in combination with the analyzer was found to be similar to the simulation and is discussed below.

Analyzer and Detector

Simion simulations were done to obtain information on the expected performance of the analyzer, including the detector field termination. This was done by filling the entrance slit of the analyzer in the horizontal plane with 105 electrons trajectories (seven values of $\delta E$×five values of $\phi$×three values of $\delta r_1$). The initial electron kinetic energies varied by 0 to ±0.3 eV in 0.1 eV increments with respect to an $E_0$ of 2 eV. From the results, a histogram was plotted of the electrons which reached the detector at any given position (included in FIG. 12). The simulated resolution can be seen to be similar to that predicted by Eq. 7, but the dispersion is noticeably different, as can be seen in FIG. 13. Adjusting the grid size and time step of the simulation did not appreciably affect this result, and we attribute this small discrepancy to the numerical inaccuracies of the technique.

Energy Dispersion and Resolution

The energy dispersion of the complete multi-channel analyzer, including the electronics, was measured using two different methods. For each method, the monochromator and analyzer were set for $E_0$=2.0 eV.

In the first method, the monochromator and analyzer zoom lenses were set for a nominal beam energy of 10 eV, and the position of the elastic peak on the detector was recorded as the monochromator zoom lens acceleration was varied by ±0.30 eV. The experimental results were obtained by reflecting the incident electron beam from a negative potential applied to the sample substrate so that there would be no energy losses to interfere with the observation of the inherent characteristics of the analyzer and zoom lens system. The results are plotted in FIGS. 12 and 13 along with the numerical and Simion results described above. Unlike the calculations, the positions of the peaks in the experimental results are not absolute. This is because the energies of the electrons entering the analyzer are known only approximately because of small work function differences that inevitably exist between the monochromator and analyzer. Consequently, after setting the monochromator for 10 eV, the analyzer was simply adjusted so that the beam struck the center of the detector, i.e., the $\delta E/E_0=0$ peak was forced to be located at $6r_2/r_0=0$. The energies of all other peaks are relative to the energy of this central one. This being done, it can be seen from FIG. 12, FIG. 13, and Eq. 6 that the experimental dispersion is very similar to that expected from both types of calculations.

The second method used for measuring the dispersion was really a check of Eq. (6) to see if it could accurately compute the peak positions, relative to the elastic peak, of electrons inelastically scattered from samples that have known energy-loss features. Propane was chosen for gas-phase measurement and benzene was chosen for the condensed phase (50 Angstrom thick neat film) since EELS of both molecules have been reported previously, measured with conventional spectrometers under conditions that we are able to reproduce in the present embodiment. The energy loss of the three largest peaks of each molecule is listed in Table 1. It can be seen that the largest energy discrepancy is 3 meV, about the same accuracy for which the peak location can be determined. Given this confirmation and the similarity of the experimental results to the numerical one, it was conclude that application of Eq. (6) is a valid way to calibrate the new multi-channel analyzer with an expected accuracy of about 2 meV.

TABLE 1

Selected Experimental Loss Energies (eV) for Benzene and Propane

| | Benzene | Propane |
|---|---|---|
| Literature value | 0.083 0.197 0.378 | 0.110 0.173 0.363 |
| Present Embodiment | 0.085 0.198 0.377 | 0.110 0.173 0.360 |

The apparent resolution of the experimental results shown in FIG. 12 is about 8 meV, somewhat worse than that indicated by the Simion and numerical results. This difference occurs because the observed peak shape in the experimental data is a convolution of contributions from both the analyzer and the monochromator while the other results are for the analyzer alone. This degrades the actual resolution by a factor of $\sqrt{2}$, assuming Gaussian shaped peaks. Thus, the actual analyzer resolution is ~6 meV, similar to the resolution predicted by the calculations and measured for the original single-channel analyzer. Curiously, the experimental peak widths are nearly constant across the face of the detector. This suggests that small changes in the energy distribution of the monochromator at each incident energy result in convolutions with those of the analyzer in a way that cancel two opposed trends.

Zoom Lens Focusing Conditions

The lens potentials required to focus electrons onto the sample and then into the entrance slit of the analyzer were determined experimentally. This was done for electrons scattered from a clean Ag substrate with incident energies between 3 and 14 eV by simultaneously maximizing the count rate and minimizing the peak width of the elastic peak by adjusting the voltages applied to lens elements $Z_{1,6}$ and $Z_{2,5}$. The monochromator and analyzer zoom lenses were constrained to be symmetric (i.e., the potentials on $Z_1=Z_6$ and those on $Z_2=Z_5$) and the $E_0$ were fixed at 2 eV. From this set of data, a table of lens voltages vs. incident energy was compiled. All subsequent spectra were measured using this table.

Transmission Functions

The electron transmission functions of the zoom lenses predicted by Simion for electrons with nominal energies of 1, 10, and 20 eV are plotted in FIG. 14. These results are compared to the measured transmission function of electrons with a nominal energy of 10 eV. It can be seen that transmission drops at the edges of the detector compared to the transmission in the center. For lower incident energies, the transmission drops more. Consequently, the intensities of all spectra must be corrected by the appropriate transmission function. Improvement of the chromatic properties of the zoom lenses is expected to improve detection efficiency.

Applications

Figure 15:
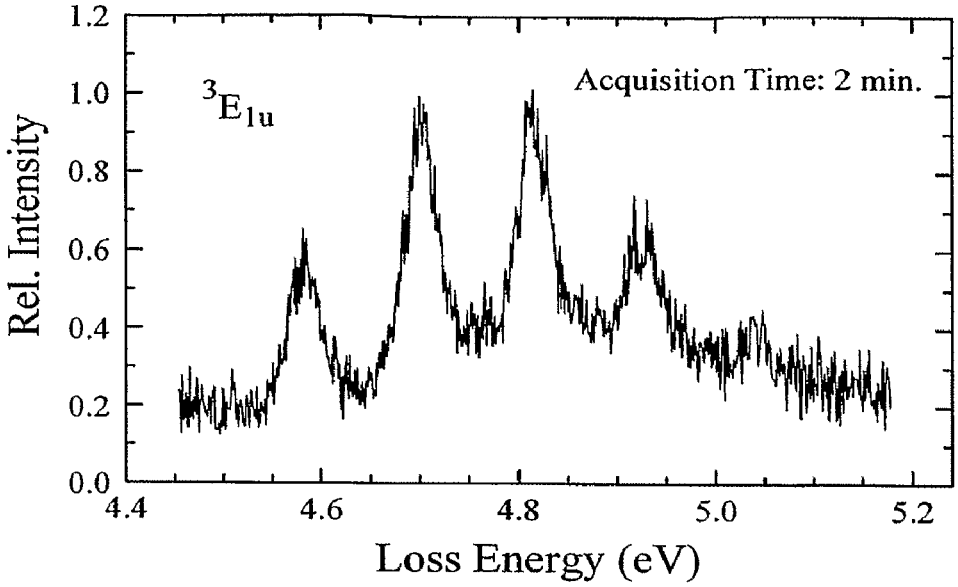
FIG. 15 provides spectrum of the 3E1u electronic state of benzene measured with a 50 Angstrom thick neat film using incident electron energy of 14 eV. The acquisition time was 2 min.

To illustrate the capabilities of the new instrument, it was used to measure a part of the electronic spectra of two condensed samples, benzene and endo-benzotricyclo[4.2.1.$0^{2,5}$]nonane. FIG. 15 provides Spectrum of the $^3E_{1u}$ electronic state of benzene measured with a 50 Å thick neat film using an incident electron energy of 14 eV. The acquisition time was 2 min. The spectrum of the $^3E_{1u}$ electronic state of benzene (FIG. 15) was measured with a 50 Angstrom thick film of neat benzene deposited on the Ag(111) crystal, using an incident electron energy of 14 eV. The most significant point about the spectrum is that the acquisition time was only 2 min.

Figure 16:
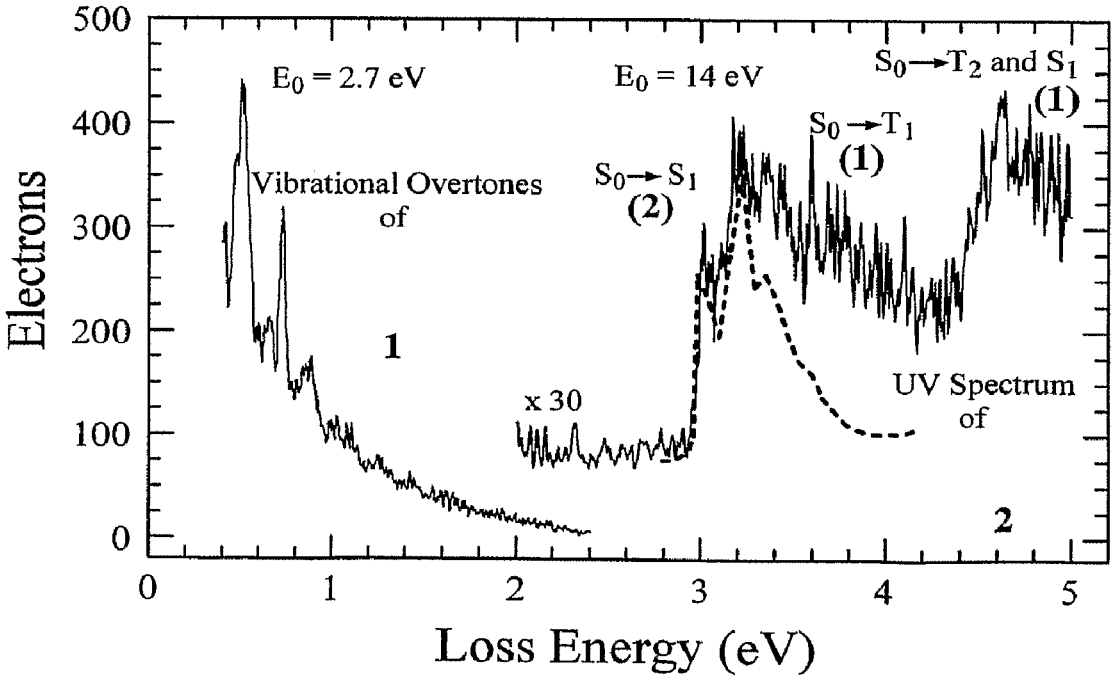
FIG. 16 provides a spectrum of endo-benzotricyclo [4.2.1.02.5]nonane (1) showing the formation of the o-xylylene derivative 2 due to irradiation by the electrons.

The spectrum of endo-benzotricyclo[4.2.1.$0^{2,5}$]nonane was measured at incident energies of 2.7 and 14 eV in the specular direction with a 20 Angstrom thick film of the sample diluted 1:5 in Ar deposited over a 50 Angstrom thick layer of pure Ar. With an incident energy of 2.7 eV, we observed a stable vibrational spectrum of endo-benzotricyclo [4.2.1.$0^{2,5}$]nonane. FIG. 16 provides a spectrum of endo-benzotricyclo[4.2.1.$0^{2,5}$]nonane (labeled as 1) showing the formation of the o-xylylene derivative (labeled in the figure as 2) due to irradiation by the electrons. However, when the incident energy was increased to 14 eV, the right hand portion of FIG. 16 was observed. It is likely that this portion of FIG. 16 contains a superposition of the spectra of the benzene-like compound endo-benzotricyclo[4.2.1.$0^{2,5}$]nonane (1), and the o-xylylene derivative (2), because the leading band in the observed spectrum is identical with that in the UV spectrum of the o-xylylene derivative. It is suspected that endo-benzotricyclo[4.2.1.$0^{2,5}$]nonane is transformed into the o-xylylene derivative under the influence of the electron beam, just as it is under UV irradiation. Such a chemical reaction would have precedent. E.g., the transformation of solid films of cyclopropane into propene, the production of CO within condensed methanol, and the formation of $Cl_2$ within condensed 1,2-$C_2F_4Cl_2$ all have been reported earlier.

As shown in the left-hand portion of FIG. 16, relatively strong vibrational overtone and combinations bands are likely to obscure any low-energy electronic transitions. The presently unknown $S_0 \rightarrow T_1$ transition in the o-xylylene derivative would be expected to occur in this region, and the situation illustrates a problem that probably will be common in studies of very low energy electronic transitions.

As demonstrated above, the wide-gap, multichannel cylindrical deflection electron energy analyzer of the present invention is suitable for measuring the weak signals characteristic of matrix-isolated samples or electronic spectra. Because the analyzer has nearly ideal fringing field termination, it was possible to characterize its resolution and energy dispersion as a function of energy by solving numerically the theoretical equation of motion of electrons in an ideal cylindrical electric field. The numerical results are closely approximated by a second order polynomial that gives the radial location of the electrons at the detector as a function of the entrance location, angle, and energy. The experimental results matched closely those predicted numerically and show that the analyzer itself has a detection efficiency that is 100-150 times better than an equivalent single-channel instrument. In practice, this efficiency is reduced to a factor of 50-100 because of the limited energy transmission of the best available zoom lens system.

The performance of the new instrument was demonstrated by measuring parts of the electronic spectra of benzene and endo-benzotricyclo[4.2.1.$0^{2,5}$]nonane. Significantly, the spectrum of the $^3E_{1u}$ electronic state of benzene was acquired in only 2 min.

Example 2

Experimental and Theoretical Study of Vibrationally Inelastic Electron Scattering on Propane Vibrational electron energy loss spectra were measured for propane at incident energies of 3, 6, 10, 15, 20, and 25 eV at scattering angles of 40, 55, 70 and 100° using an EELS instrument as described in Example 1. The spectra obtained from the EELS instrument were compared with the results of ab initio calculations using a recently developed two-channel discrete momentum representation (DMR) method (see, for example, Mazevet et al. (2001) Phys. Rev. A vol. 64, 040701).

Methods

Research grade propane (99.9%) was obtained from Scott Specialty Gases and used as obtained. The pressure of propane in the collision region was estimated at $10^{-5}$ torr, while the pressure in the chamber is of the order of $10^{-7}$ torr. Only relative cross-sections were measured. For each measured spectrum the area and half-width of the elastic peak were determined by fitting to a Lorentzian.

The calculations were done by the Discrete Momentum Representation (DMR) method extended recently to vibrationally inelastic scattering of electrons by polyatomic molecules (Mazevet et al. (2001) Phys. Rev. A vol. 64, 040701). The calculations were done for six different energies of the incident electron: 3, 6, 10, 15, 20, and 25 eV. An inherent feature of the DMR method is that it gives differential cross sections only for a set of pairs of k vectors that are fixed by the angular numerical quadrature. Differential cross sections for any other required scattering angles are obtained by interpolation. In this way, differential cross sections at all six energies for scattering angles of 40, 55, 70 and 90° were obtained.

The ratio of the calculated differential cross section for elastic scattering and the area of the observed elastic peak were used to scale the whole experimental spectrum. Intensities of bands were calculated by numerical integration of the scaled spectrum. The band corresponding to the manifold of CH stretches was integrated from 320 to 420 meV, and a region for HCH deformation modes was integrated from 130 to 240 meV. The calculated differential cross sections for vibrational transitions were converted to a theoretical band spectrum by assuming a Lorentzian shape for all bands with a half-width that was taken from the observed elastic peak. The bands were centered at the positions of observed vibrational frequencies (see Mazevet et al.)

Results

The measured spectra are presented in FIGS. 17-25 and compared with the DMR calculations.

Figure 17:
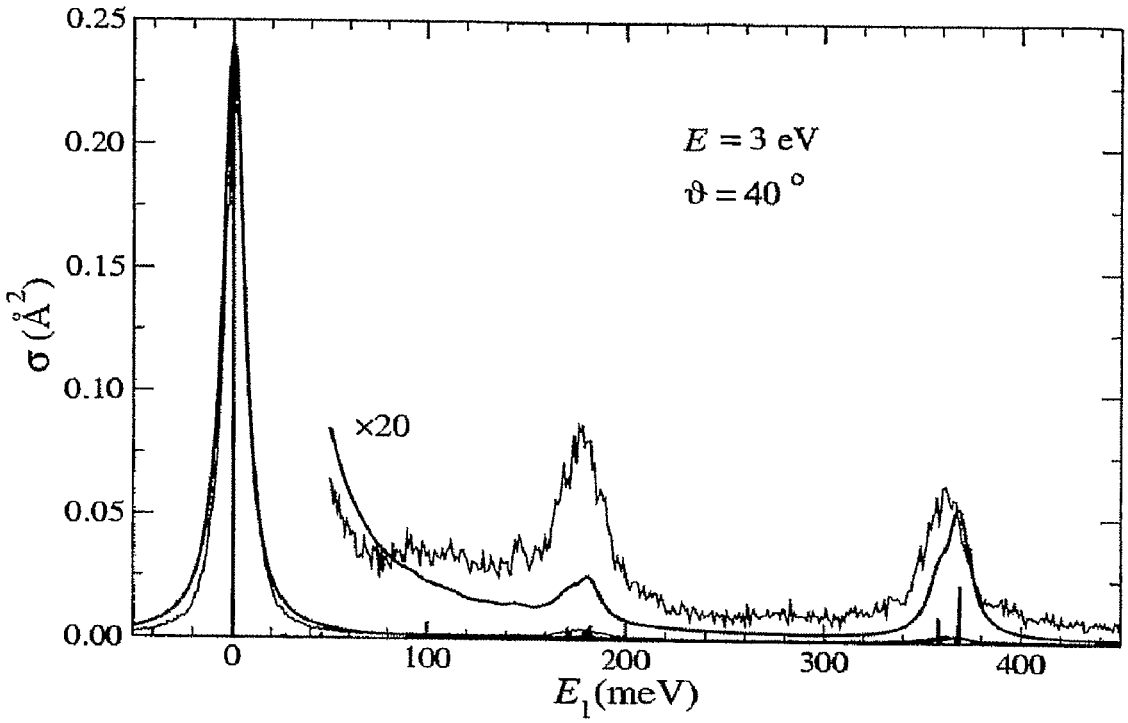
FIG. 17 shows the electron energy loss spectrum of propane (thin jagged line) measured by an EEL spectrometer of the present invention and the calculated spectrum (thick smooth line) for the incident electron energy of 3 eV and the scattering angle of 40°. The bars at the bottom of the figure stand for the calculated differential cross sections.
Figure 18:
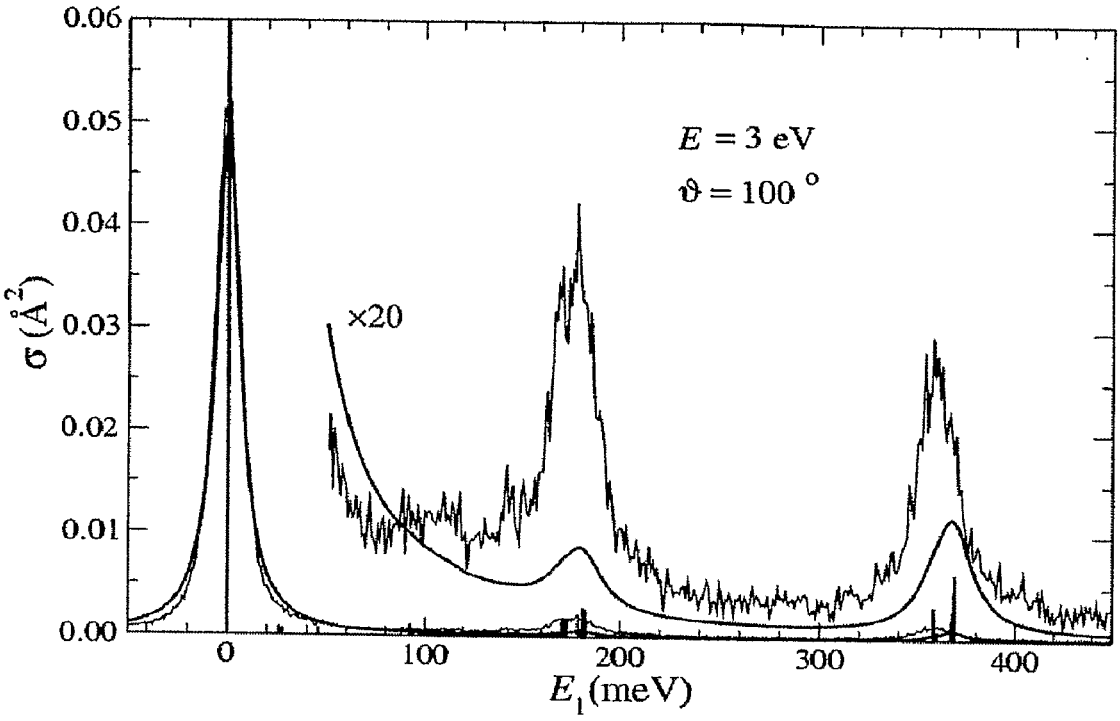
FIG. 18 shows the electron energy loss spectrum of propane (thin jagged line) measured by an EEL spectrometer of the present invention and the calculated spectrum (thick smooth line) for the incident electron energy of 3 eV and the scattering angle of 100°. The bars at the bottom of the figure stand for the calculated differential cross sections.
Figure 19:
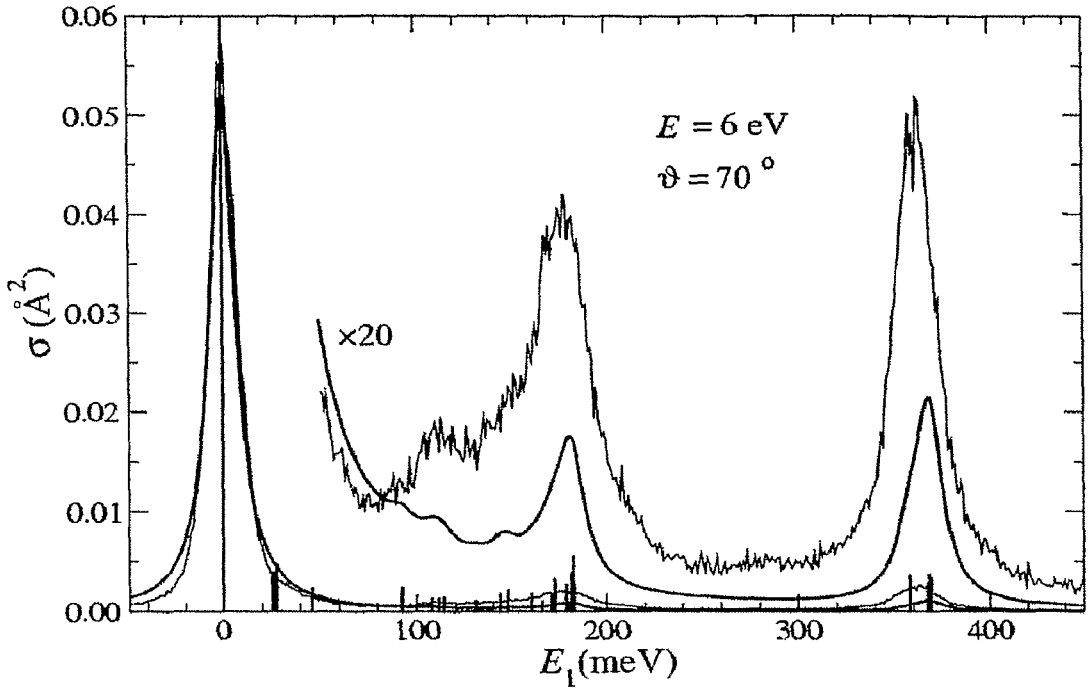
FIG. 19 shows the electron energy loss spectrum of propane (thin jagged line) measured by an EEL spectrometer of the present invention and the calculated spectrum (thick smooth line) for the incident electron energy of 6 eV and the scattering angle of 70°. The bars at the bottom of the figure stand for the calculated differential cross sections.
Figure 20:
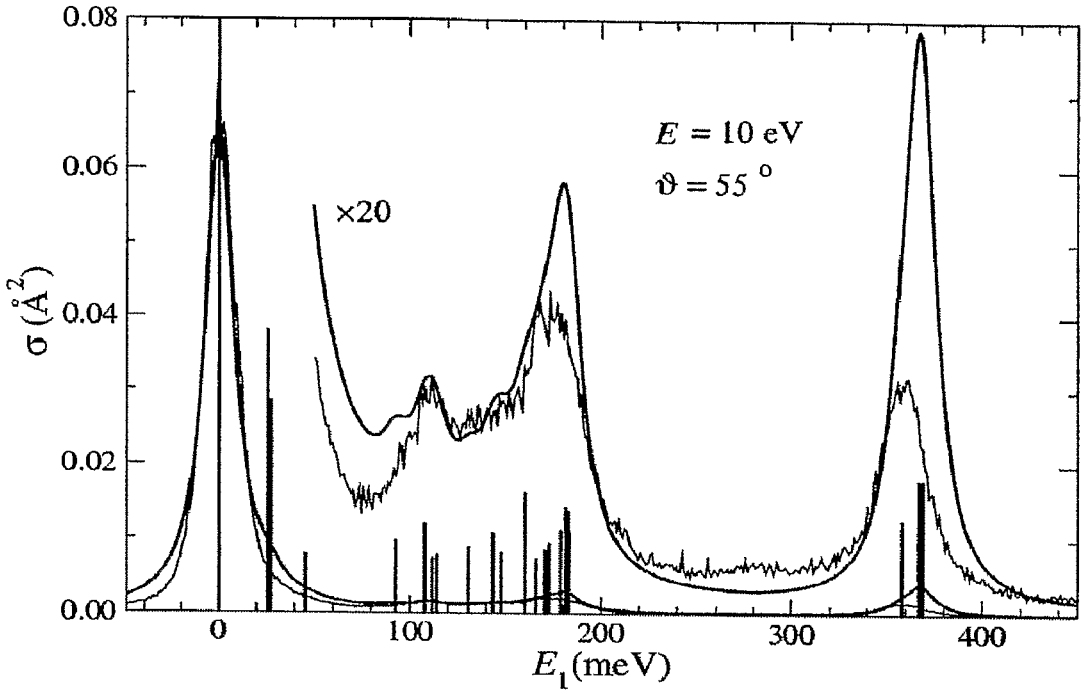
FIG. 20 shows the electron energy loss spectrum of propane (thin jagged line) measured by an EEL spectrometer of the present invention and the calculated spectrum (thick smooth line) for the incident electron energy of 10 eV and the scattering angle of 55°. The bars at the bottom of the figure stand for the calculated differential cross sections.
Figure 21:
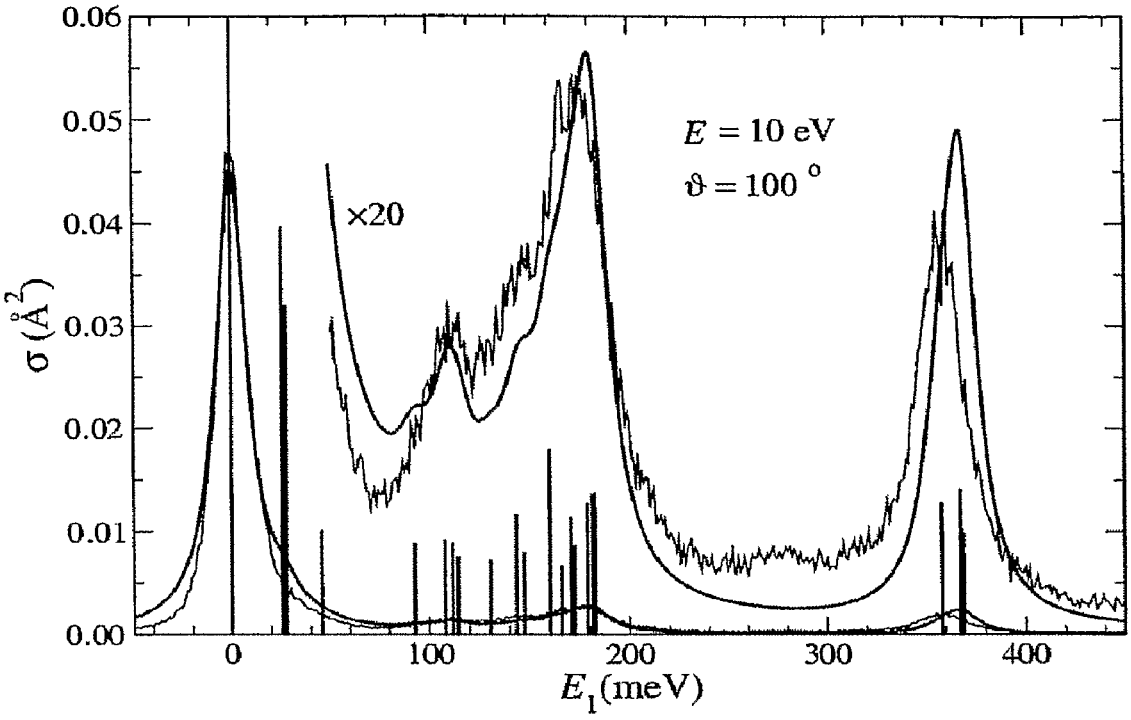
FIG. 21 shows the electron energy loss spectrum of propane (thin jagged line) measured by an EEL spectrometer of the present invention and the calculated spectrum (thick smooth line) for the incident electron energy of 10 eV and the scattering angle of 100°. The bars at the bottom of the figure stand for the calculated differential cross sections.
Figure 22:
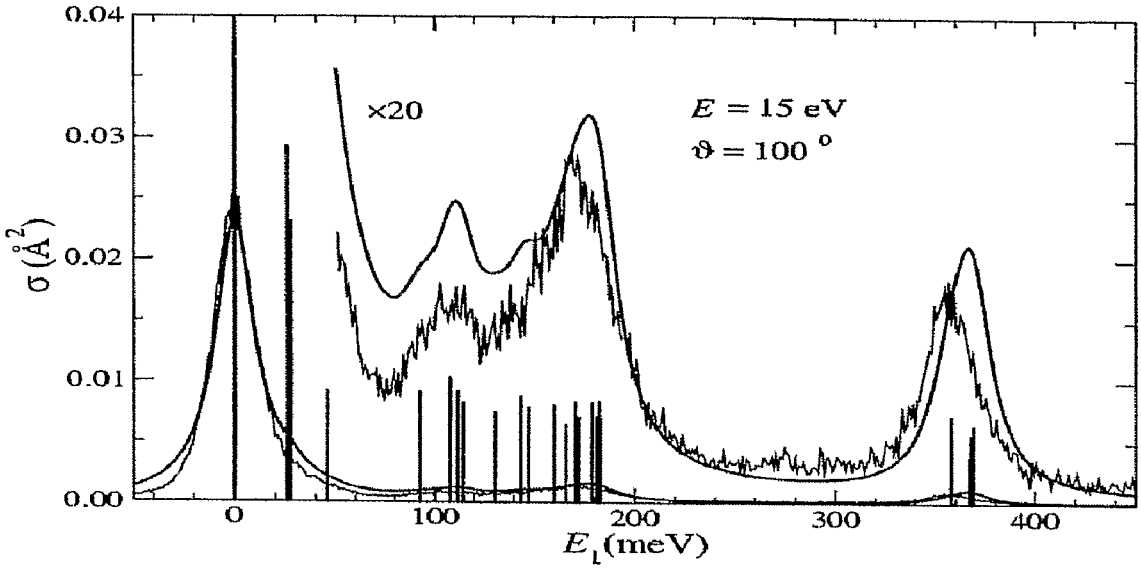
FIG. 22 shows the electron energy loss spectrum of propane (thin jagged line) measured by an EEL spectrometer of the present invention and the calculated spectrum (thick smooth line) for the incident electron energy of 15 eV and the scattering angle of 100°. The bars at the bottom of the figure stand for the calculated differential cross sections.
Figure 23:
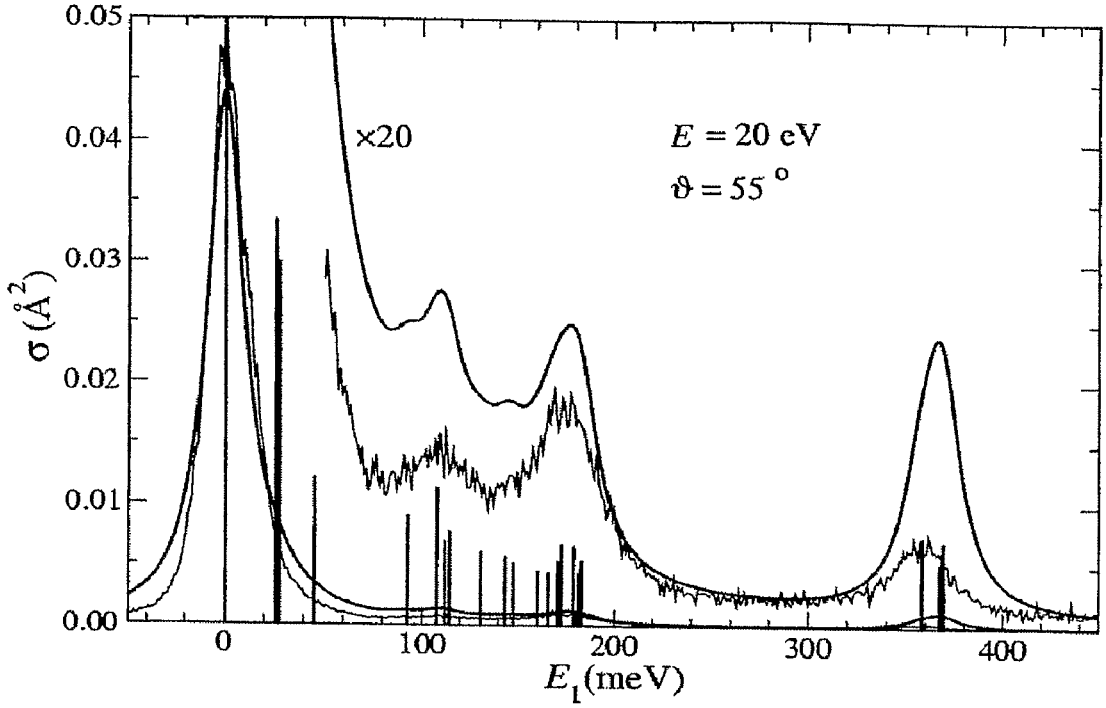
FIG. 23 shows the electron energy loss spectrum of propane (thin jagged line) measured by an EEL spectrometer of the present invention and the calculated spectrum (thick smooth line) for the incident electron energy of 20 eV and the scattering angle of 55°. The bars at the bottom of the figure stand for the calculated differential cross sections.
Figure 24:
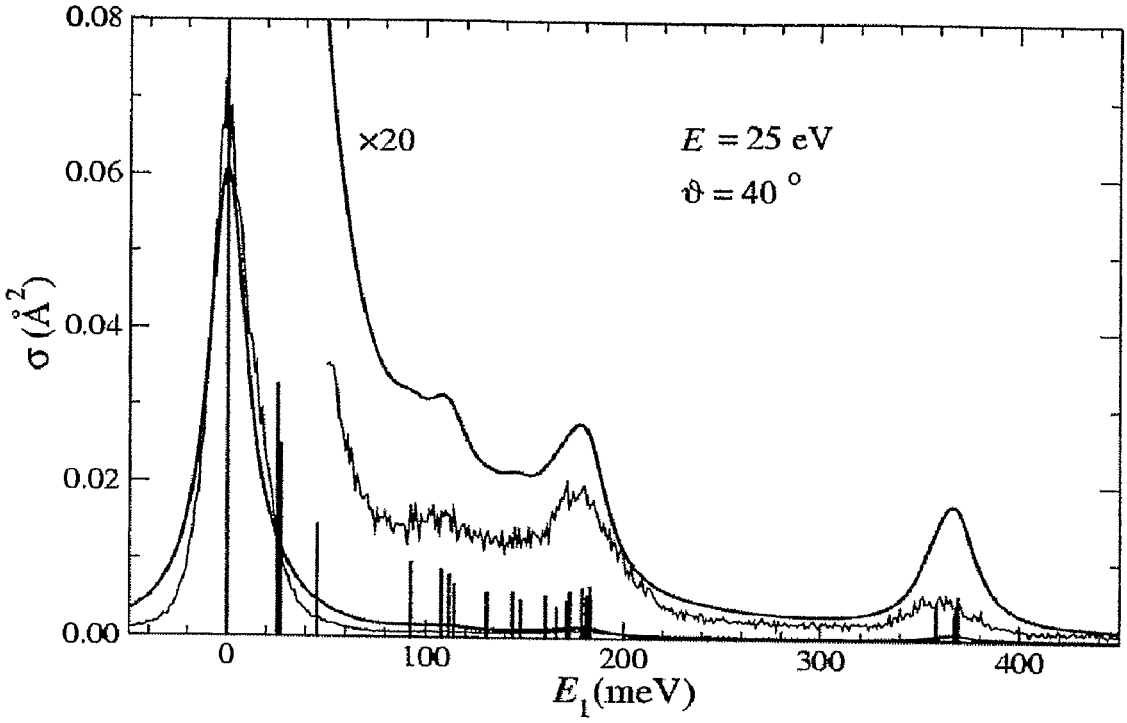
FIG. 24 shows the electron energy loss spectrum of propane (thin jagged line) measured by an EEL spectrometer of the present invention and the calculated spectrum (thick smooth line) for the incident electron energy of 25 eV and the scattering angle of 40°. The bars at the bottom of the figure stand for the calculated differential cross sections.
Figure 25:
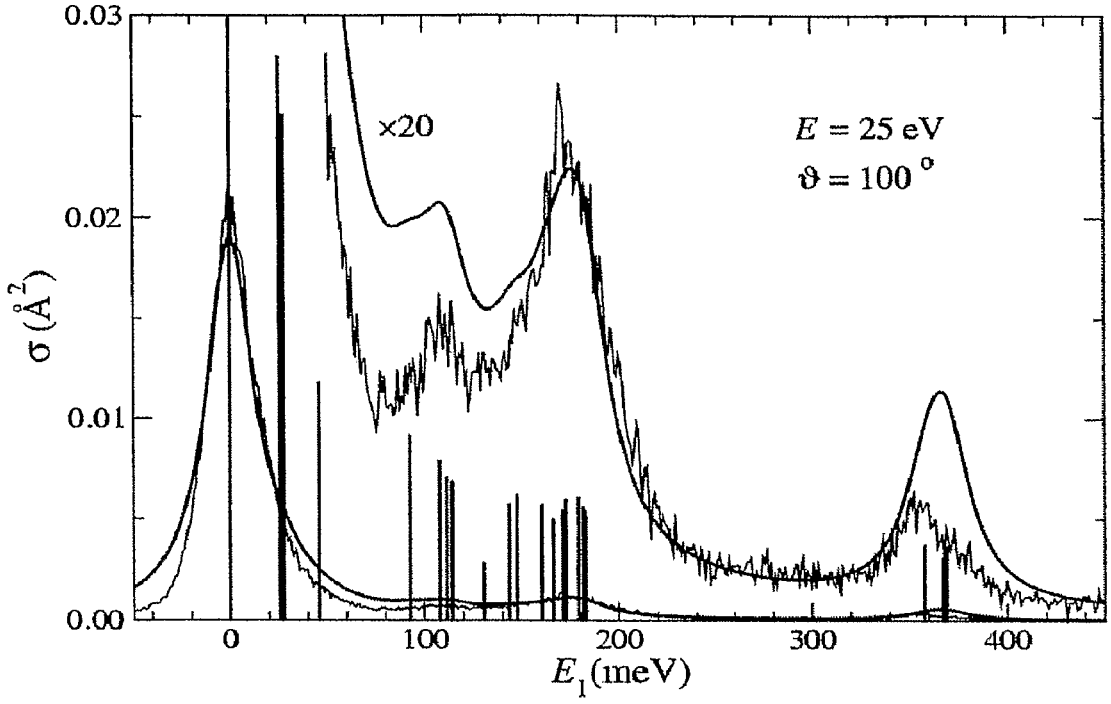
FIG. 25 shows the electron energy loss spectrum of propane (thin jagged line) measured by an EEL spectrometer of the present invention and the calculated spectrum (thick smooth line) for the incident electron energy of 25 eV and the scattering angle of 100°. The bars at the bottom of the figure stand for the calculated differential cross sections.

In FIGS. 17-25, the measured electron energy loss spectrum of propane by an instrument of the present invention is shown by a thin jagged line. The calculated spectrum is shown in the figures as a thick smooth line. FIGS. 17 and 18 show the electron energy loss spectra of propane for the incident electron energy of 3 eV and scattering angles of 40° and 100°, respectively. FIG. 19 shows the spectrum for 6 eV and a scattering angle of 70°. FIGS. 20 and 21 show the spectra for 10 eV and scattering angles of 55° and 100°, respectively. FIG. 22 shows the spectrum for 15 eV and a scattering angle of 100°. FIG. 23 shows the spectrum for 20 eV and a scattering angle of 55°. FIG. 24 shows the spectrum for 25 eV and a scattering angle of 40°. FIG. 25 shows the spectrum for 25 eV and a scattering angle of 100°. The bars at the bottom of the figures stand for the calculated differential cross sections.

The results indicate that the spectra obtained by the EEL spectrometer of the present invention were consistent, reproducible and useful for a variety of different incident electron energies and scattering angles. Furthermore, the spectra obtained by the EEL spectrometer were repeatedly in agreement with calculated values. The neglect of polarization effects in the calculations is believed to be the chief source of any discrepancies observed.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description.

All references cited in this application are hereby incorporated in their entireties by reference herein to the extent that they are not inconsistent with the disclosure in this application. It will be apparent to one of ordinary skill in the art that methods, devices, device elements, materials, procedures and techniques other than those specifically described herein can be applied to the practice of the invention as broadly disclosed herein without resort to undue experimentation. All art-known functional equivalents of methods, devices, device elements, materials, procedures and techniques specifically described herein are intended to be encompassed by this invention.

When a group of materials, compositions, components or compounds is disclosed herein, it is understood that all individual members of those groups and all subgroups thereof are disclosed separately. When a Markush group or other grouping is used herein, all individual members of the group and all combinations and subcombinations possible of the group are intended to be individually included in the disclosure. Every formulation or combination of components described or exemplified herein can be used to practice the invention, unless otherwise stated. Whenever a range is given in the specification, for example, a temperature range, a time range, or a composition range, all intermediate ranges and subranges, as well as all individual values included in the ranges given are intended to be included in the disclosure.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms.

I claim:

1. A charged particle kinetic energy analyzer comprising a charged particle deflector having a proximal end and a distal end, said deflector comprising:

a) an inner electrode having a cylindrical shape;

b) an outer electrode having a cylindrical shape, wherein said inner and outer electrodes are separated from each other by a selected distance, wherein application of different electric potentials to said inner and outer electrodes establishes an electric field in said deflector, wherein charged particles conducted through said deflector are spatially separated on the basis of their energies; and c) a field termination system comprising a plurality of resistive termination elements positioned across the distal end of said deflector and in the path of said charged particles, wherein said resistive termination elements transmit at least a portion of said charged particles.

2. The analyzer of claim 1 wherein said plurality of resistive termination elements is highly transparent with respect to said charged particles.

3. The analyzer of claim 1 further comprising an electric potential applied to said resistive termination elements, wherein application of said electric potential generates an electric field across said resistive termination elements.

4. The analyzer of claim 1 wherein said resistive termination elements each have a first end electrically connected with said inner electrode end and a second end electrically connected with said outer electrode, wherein the composition and physical dimensions of said resistive termination elements are selected to provide a terminating electric field that approximates the electric field in said charged particle deflector.

5. The analyzer of claim 1 wherein the electric field in said deflector varies substantially logarithmically, and wherein said plurality of resistive termination elements provides a terminating electric field that varies linearly in a manner that approximates said logarithmic electric field of said deflector.

6. The analyzer of claim 1 wherein said resistive termination elements are positioned in a parallel array.

7. The analyzer of claim 1 wherein said resistive termination elements have an electrical resistivity equal to or greater than 80 Ω-m.

8. The analyzer of claim 1 wherein said resistive termination elements comprise resistive fibers, tubes, strips or ribbons.

9. The analyzer of claim 1 wherein the electrical resistivity of said resistive termination elements selectively increases or decreases across the length of the resistive termination elements.

10. The analyzer of claim 1 wherein said resistive termination elements comprise a material selected from the group consisting of graphite, carbon fiber, a semi-conducting polymer material, a ceramic material and a hybrid material.

11. The analyzer of claim 1 wherein said deflector further comprises an entrance plate comprising an entrance aperture, wherein said entrance plate is connected to the proximal end of said inner and outer electrodes.

12. The analyzer of claim 11 wherein said entrance plate comprises an insulating material, an intermediate conductive layer covering at least part of the insulating material, and a surface resistive film coating the insulating material and conductive layer; wherein said conductive layer has a first point of electrical contact with said outer electrode and a second point of electrical contact with said inner electrode, wherein the position of said first and second points of electrical contact are selected to provide a terminating electric field that approximates the electric field in said deflector.

13. The analyzer of claim 1 wherein said deflector further comprises an exit plate comprising an exit window, wherein said exit plate is connected to the distal end of said inner and outer electrodes.

14. The analyzer of claim 13 wherein said plurality of resistive termination elements is positioned within said exit window.

15. The analyzer of claim 13 wherein said exit plate comprises an insulating material, an intermediate conductive layer covering at least part of the insulating material, and a surface resistive film coating the insulating material and conductive layer; wherein said exit plate has a first point of electrical contact with said outer electrode and a second point of electrical contact with said inner electrode, wherein the position of said first and second points of electrical contact are selected to provide a terminating electric field that approximates the electric field in said deflector.

16. The analyzer of claim 1 wherein said resistive termination elements are electrically connected to an independent power supply, wherein the composition and physical dimensions of said resistive termination elements are selected to provide a terminating electric field that approximates the electric field in said charged particle deflector.

17. The analyzer of claim 1 wherein said deflector further comprises a top plate and bottom plate each comprising an insulating material, an intermediate conductive layer covering at least part of the insulating material, and a surface resistive film coating the insulating material and conductive layer, wherein said conductive layer of the top plate and bottom plate has an inner edge in electrical contact with said inner electrode and an outer edge in electrical contact with said outer electrode.

18. A transparent field termination system comprising:

a) a plurality of resistive termination elements positioned in the path of charged particles, wherein said resistive termination elements transmit at least a portion of said charged particles, and wherein each of said resistive termination elements has a first and second end; and b) an electric potential applied to said first and second ends of each resistive termination element, wherein application of said electric potential generates an electric field across said plurality of resistive termination elements.

19. The field termination system of claim 18 wherein said resistive termination elements have a diameter equal to or less than 10 microns.

20. The field termination system of claim 18 wherein said electric field varies linearly as a function of length of the resistive termination elements.

* * * * *